United States Patent [19]

Wahle

[11] 4,030,511

[45] June 21, 1977

[54] CONTROL SYSTEM FOR CIGARETTE PRODUCING AND PROCESSING MACHINES OR THE LIKE

[75] Inventor: Günter Wahle, Reinbeck, Germany

[73] Assignee: Hauni-Werke Korber & Co., KG, Hamburg, Germany

[22] Filed: Oct. 15, 1974

[21] Appl. No.: 515,009

Related U.S. Application Data

[63] Continuation of Ser. No. 406,396, Oct. 15, 1973, abandoned, which is a continuation of Ser. No. 111,807, Feb. 2, 1971, abandoned.

[30] Foreign Application Priority Data

| | | |
|---|---|---|
| Feb. 7, 1970 | Germany | 2005665 |
| May 6, 1970 | Germany | 2022174 |

[52] U.S. Cl. ..... 131/21 R

[51] Int. Cl.[2] ..... A24B 7/14

[58] Field of Search ..... 131/21 R, 21 A, 21 B, 131/25; 318/410, 411, 414, 64, 327, 231, 174, 177, 179, 268, 271, 305, 306, 344, 443, 455

[56] References Cited

UNITED STATES PATENTS

| | | | |
|---|---|---|---|
| 1,343,345 | 6/1920 | Brown | 318/414 |
| 1,864,728 | 6/1932 | Hawkins et al. | 131/21 B |
| 2,745,410 | 5/1956 | Molins | 131/25 |
| 2,861,683 | 11/1958 | Gilman | 131/21 B |
| 2,909,180 | 10/1959 | Molins et al. | 131/21 B |
| 2,945,497 | 7/1960 | Powell | 131/21 B |
| 2,954,775 | 10/1960 | Radley et al. | 131/21 B |
| 3,105,180 | 9/1963 | Burnett | 318/231 |
| 3,190,459 | 6/1965 | Kochalski et al. | 214/1 R |
| 3,249,839 | 5/1966 | Fay | 318/327 |
| 3,412,856 | 11/1968 | Esenwein | 131/21 R |
| 3,557,797 | 1/1971 | Williamson et al. | 131/21 B |
| 3,586,006 | 6/1971 | Wendt | 131/21 R |
| 3,596,797 | 8/1971 | Wallenborn | 131/21 A |

FOREIGN PATENTS OR APPLICATIONS

| | | | |
|---|---|---|---|
| 326,702 | 3/1930 | United Kingdom | 131/21 A |
| 1,089,764 | 11/1967 | United Kingdom | 131/21 R |

OTHER PUBLICATIONS

Mechanical Engineers' Handbook, Marks, 4th Edition, McGraw Hill Book Co. N.Y. City, 1941, pp. 2019 & 2020.

*Primary Examiner*—Warner H. Camp
*Attorney, Agent, or Firm*—Peter K. Kontler; John Kurucz

[57] ABSTRACT

A production line consisting of a cigarette making machine, a filter cigarette making machine and a packing machine or of a filter rod making machine and several filter cigarette making machines is controlled by a circuit which regulates the speed of the prime mover for the cigarette making machine or filter rod making machine in such a way that the speed changes gradually and smoothly from zero to a lower speed, from a lower speed to a higher speed, from a higher speed to a lower speed, from a higher speed to zero, or from a lower speed to zero. The changes in speed can be initiated by the operators or in response to signals which are generated by detectors serving to scan the operation of certain parts in one or more machines of the production line. The prime mover consists of a variable-speed motor, a constant-speed motor and a variable-torque clutch, or a constant-speed motor in combination with a variable-speed transmission.

9 Claims, 18 Drawing Figures

Inventor:
GÜNTER NAHLE
BY
ATTORNEY

Inventor:
GÜNTER WAHLE
Nelson S. Stricker
BY
ATTORNEY

Inventor:
GÜNTER WAHLE

Richard S. Sta[illegible]
BY
ATTORNEY

Inventor:
GÜNTER WAHLE
Anwalt J. Stricker

Inventor:
GÜNTER WAHLE
by Leon J. Stecker

Inventor:
GÜNTER WAHLE
BY
ATTORNEY

Inventor:
GÜNTER WAHLE
BY
ATTORNEY

Inventor:
GÜNTER WAHLE
BY
ATTORNEY

Inventor:
GUNTER UAHLE

BY

ATTORNEY

Inventor:
GUNTER WAHLE
Arnold S. Weiler

CONTROL SYSTEM FOR CIGARETTE PRODUCING AND PROCESSING MACHINES OR THE LIKE

This application is a continuation of now abandoned application Ser. No. 406,396 filed Oct. 15, 1973 which was a continuation of now abandoned application Ser. No. 111,807 filed Feb. 2, 1971.

BACKGROUND OF THE INVENTION

The present invention relates to apparatus for the production and processing of rod-like articles, and more particularly to improvements in control systems for groups of machines (hereinafter called production lines) which are designed to produce and to process rod-like articles of the type wherein a tubular wrapper surrounds a filler of tobacco and/or filter material. Still more particularly, the invention relates to improvements in control systems for the prime movers of one or more machines in groups of machines which are employed to produce plain cigarettes, filter cigarettes, plain or filter-tipped cigars, cigarillos and/or filter rods and filter rod sections.

Presently known prime movers for cigarette making machines normally employ motors which can drive the moving parts of such machines at several speeds. As a rule, the motor is operated at two speeds, namely, at a lower speed for starting the machine and for operating it during a certain interval of time, and at a higher or normal operating speed at which the machine can turn out as many as 4,000 cigarettes per minute. The operation at a lower speed is desirable when it becomes necessary to make certain adjustments while the machine is running. Many recent types of cigarette rod making machines employ a pole-changeable electric motor wherein the speed of revolving field varies inversely with the number of poles. Thus, the larger the pole number, the lower is the rotor speed and vice versa. Conventional mechanical, electrical or hydraulic clutches are employed in an attempt to prevent abrupt acceleration and eventual damage to parts of the machine when the motor is started or during speed changing. Means for preventing abrupt acceleration are particularly desirable in modern machines wherein the rotary parts must be rapidly accelerated from zero speed to a very high speed. However, a commercially available clutch cannot always prevent the production of defective articles, especially during acceleration from zero speed to a lower speed, during acceleration from a lower speed to a normal operating speed, and/or during deceleration from operating speed or from lower speed. It was found that the cigarettes which are produced during acceleration of the prime mover are underweight and that the cigarettes which are produced during deceleration of the machine are often overweight. The production of heavier cigarettes can take place during deceleration from normal speed to a lower speed or during deceleration to zero speed. Furthermore, the web of cigarette paper which is used as a wrapper for a continuous tobacco filler rod in a cigarette rod making machine tends to tear in response to sudden acceleration of the machine, and such tearing invariably involves considerable losses in output because it necessitates an interruption in the opertion of the machine as well as segregation of all such cigarettes or filler rod sections which are produced subsequent to tearing and prior to completion of a splicing operation.

Another serious drawback of unsatisfactory acceleration or deceleration of cigarette rod making or like machines is that the changes in speed often affect the operation of one or more consuming machines which are normally coupled with a cigarette rod making machine to form therewith a complete production line. For example, it is customary to directly couple a cigarette rod making machine with a filter cigarette making machine or with one or more packing machines. Certain units of consuming machines are highly sensitive to changes in speed. Such units include those which are employed to supply adhesive-coated uniting bands, to supply adhesive paste, to supply blanks for envelopes which are to be converted into packs for groups of plain or filter cigarettes, to supply filter rod sections of unit length or multiple unit length, and others. It was also found that abrupt changes in the speed of a producing machine or in the speed of a consuming machine which is directly coupled with the producing machine are likely to affect the quality of products, for example, by causing slip-page of rod-shaped articles during rolling which is resorted to for wrapping of such articles in adhesive-coating uniting bands (such rolling is the customary way of convoluting adhesive-coated uniting bands around groups of coaxial plain cigarettes and filter rod sections to convert such groups into filter cigarettes of unit length or multiple unit length). Even minor slippage can result in misalignment of articles, for exmple, by preventing the articles from entering flutes or equivalent receiving means in drums or analogous conveyors serving to transport the rolled articles past one or more testing, inverting, arraying, ejecting and/or other stations.

Even though it is desirable to operate a cigarette rod making machine, a filter rod making machine, a filter cigarette making machine or an analogous machine at a maximum speed, the operating speed of such machines must be temporarily reduced at relatively frequent intervals, for example, to insure satisfactory splicing of an expiring web of cigarette paper to a fresh web, to replenish the supply of paste in certain types of pasters, and/or for other purposes. Also, the operation of a high-speed cigarette rod making or like machine can be properly inspected and altered only when the machine is not running at full speed. Furthermore, it is often necessary to reduce the operating speed of one or more producing machines in response to stoppage or deceleration of directly coupled consuming machines. This is desirable in order to avoid complete stoppage of the producing machine or machines because the likelihood of producing defective articles prior to complete stoppage or during acceleration from zero speed is much more pronounced than during acceleration from a lower speed to a higher speed or during deceleration to a lower speed. It is further desirable to change the operating speed of producing machines in a production line as a function of the requirements of consuming machines, for example, as a function of fluctuations in the supply of rod-shaped articles in the magazine of a packing machine for plain or filter cigarettes, plain or filter-tipped cigars, cigarillos or like products.

SUMMARY OF THE INVENTION

An object of the invention is to provide a novel and improved control system for regulating the speed of producing and consuming machines in production lines for the mass-manufacture of rod-shaped articles which constitute or form part of plain or filter-tipped cigarettes, cigars, cigarillos, cheroots or the like.

Another object of the invention is to provide novel and improved means for regulating the operation of prime movers for cigarette rod making machines, filter cigarette making machines, packing machines for cigarettes or the like, or of prime movers which are utilized to drive two or more consuming and/or producing machines.

A further object of the invention is to provide a control system which reduces the likelihood of production of unsatisfactory tobacco rod sections and/or filter rod sections during changes in the speed of machines which are used to produce and/or to process such rod-shaped articles.

An additional object of the invention is to provide the control system for production lines in cigarette manufacturing plants or the like with novel means for regulating the starting, stoppage, acceleration and/or deceleration of prime movers with a view to avoid damage to moving parts, to reduce the number of defective articles and to reduce waste in materials which are used for the production of such articles.

Still another object of the invention is to provide a control system which reduces the likelihood of malfunction of production lines and which can be used to regulate the speed and the operation of production lines which consist of presently known machines for the production of tobacco rod sections and/or filter rod sections.

One feature of the invention resides in the provision of a production line which is used for the making and processing of rod-shaped articles of the type havng a tubular wrapper surrounding a rod-like filler of tobacco and/or filter material. The production line comprises at least one producing machine (e.g., a cigarette rod making machine or a combination of a cigarette rod making machine with a filter cigarette making machine), at least on consuming machine (e.g., a filter cigarette making machine or a cigarette packing machine) arranged to receive and to process the output of the producing machine, variable-speed prime mover means for the producing machine (e.g., an infinitely variable-speed electric motor, a constant-speed motor in combination with an infinitely variable-torque clutch or a constant-speed motor in combination with an infinitely variable-speed transmission), and control means for effecting gradual and smooth changes in the speed of the prime mover means.

The control means is preferably designed to effect gradual and smooth changes in the speed of the prime mover means during acceleration from zero speed to a lower speed, during acceleration from a lower speed to a higher speed, during deceleration from a higher speed to a lower speed, and/or during deceleration from a higher or lower speed to zero. The control means may include signal generating means which can be actuted by persons in charge or automatically (for example, in response to changes in the requirements or condition of a producing and/or consuming machine), and speed varying means which is responsive to such signals and insures gradual acceleration or deceleration of the prime mover means.

The novel features which are considered as characteristic of the invention are set forth in particular in the appended claims. The improved control system itself, however, both as to its construction and its mode of operation, together with additional features and advantages thereof, will be best unerstood upon perusal of the following detailed description of certain specific embodiments with reference to the accompanying drawing.

DESCRIPTION OF THE PREFERRED EMBODIMENTS

Figure 1:
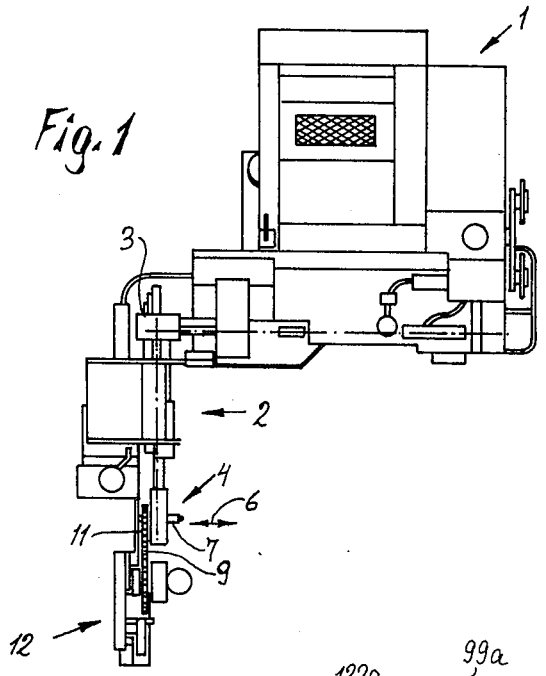
FIG. 1 is a diagrammatic plan view of a production line consisting of two producing machines and one consuming machine wherein the speed of the producing machines can be regulated by a control system which embodies one form of the invention.

FIG. 1 is a plan view of a production line which includes three machines, namely, a producing machine 1, a first processing or consuming machine 2 and a second processing or consuming machine 12. The machine 1 is a cigarette rod making machine which includes means for making and subdividing a continuous rod into plain cigarettes of desired length. In the illustrated embodiment, the machine 1 is of the type known as GARANT (produced by Hauni-Werke, Korber & Co. K.G., of 205 Hamburg 80, Western Germany) which is assumed to produce plain cigarettes of unit length. The machine 2 is of the type known as MAX (produced by Hauni-Werke) which is designed to produce filter cigarettes of unit length. The machine 12 is a packing machine which serves to provide blocks or arrays of twenty filter cigarettes each with one or more envelopes and to thus form packs which are ready for introduction into cartons or for storage.

The cigarette rod making machine 1 has a drum-shaped conveyor 3 which is provided with axially parallel peripheral flutes for reception of plain cigarettes from a cutoff 49 (FIG. 2) and serves to convert a single file of coaxial plain cigarettes into two rows wherein the cigarettes move sideways to enter the filter cigarette making machine 2.

Figure 5:
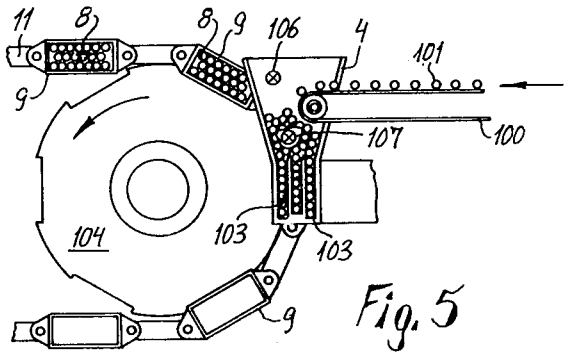
FIG. 5 is a side elevational view of block-forming unit wherein filter cigarettes issuing from the machine of FIG. 4 are grouped for introduction into the consuming machine of the production line shown in FIG. 1.

The filter cigarettes 101 (see also FIGS. 5 and 6) which issue from the machine 2 are caused to enter a magazine or hopper 4 having three substantially vertically extending ducts 103 (FIG. 5) each of which can accumulate a stack of closely adjacent parallel filter cigarettes 101. A three-progned transfer member or pusher 7 is reciprocable in directions indicated by a double-headed arrow 6 to intermittently expel from the ducts 103 arrays or blocks 8 (FIG. 5) of twenty filter cigarettes each. As shown in FIG. 5, each array 8 contains twenty filter cigarettes 101 in the customary formation, namely, two parallel outer layers of seven cigarettes each and a median layer of six cigarettes, with the cigarettes 101 of the median layer staggered relative to the cigarettes of the outer layers. The pusher 7 expels the arrays 8 into successive receptacles or cells 9 of an endless chain conveyor 11 which is trained over two srocket wheels 104 (one shown in FIG. 5) and serves to introduce the arrays 8 into the packing machine 12. The machines 1 and 2 have a common prime mover whereas the movable parts of the packing machine 12 receive motion from a separate prime mover.

It is clear that the production line of FIG. 1 can employ other types of cigarette rod making, filter cigarette making and packing machines without departing from the spirit of the invention. The packing machine 12 can be of the type as disclosed in the copending application Ser. Nos. 82,468 andl 84,727 filed by Friedel Kruse et al. and owned by the assignee of the present application.

Figure 2:
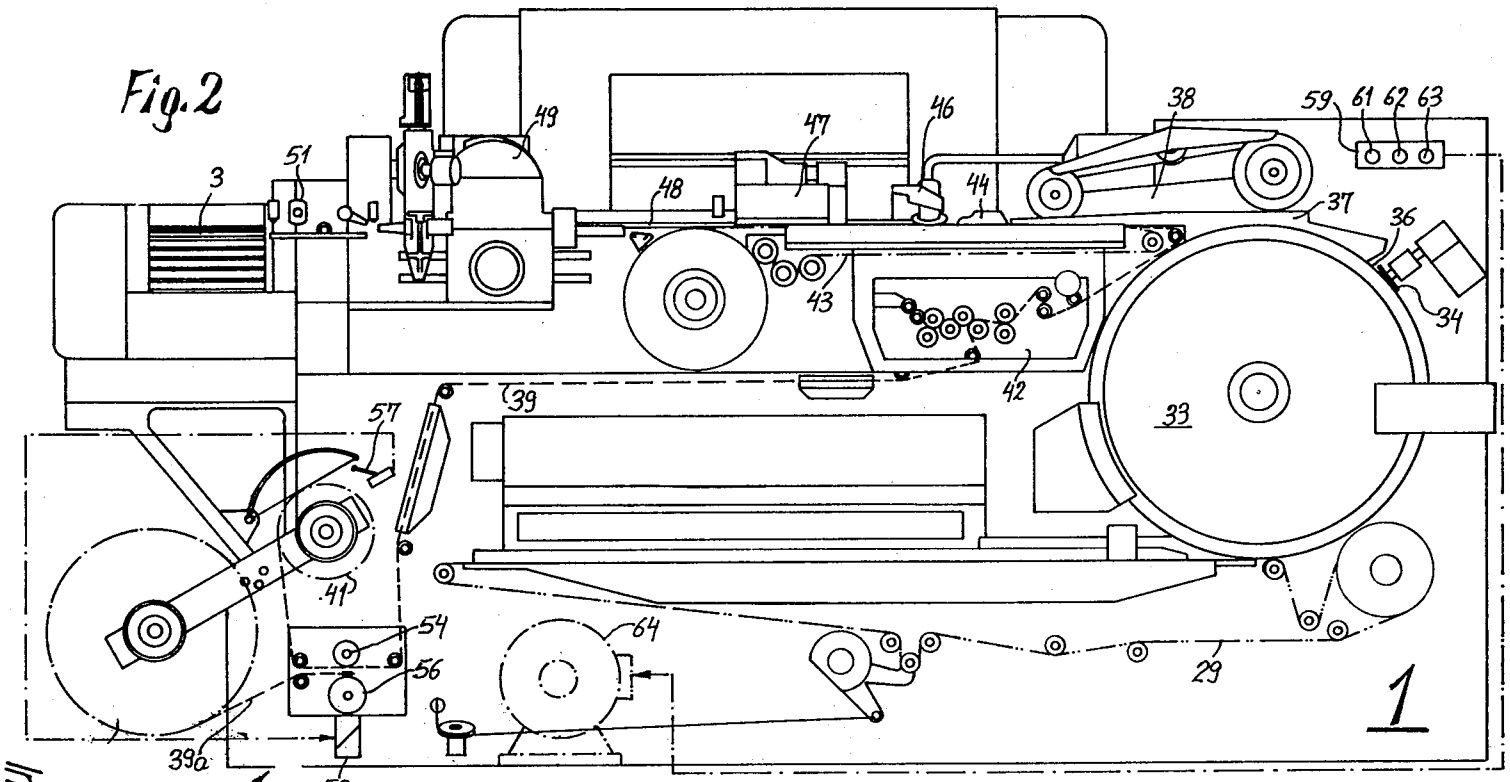
FIG. 2 is an enlarged side elevational view of a cigarette rod making machine which constitutes one of the producing machines shown in FIG. 1.
Figure 3:
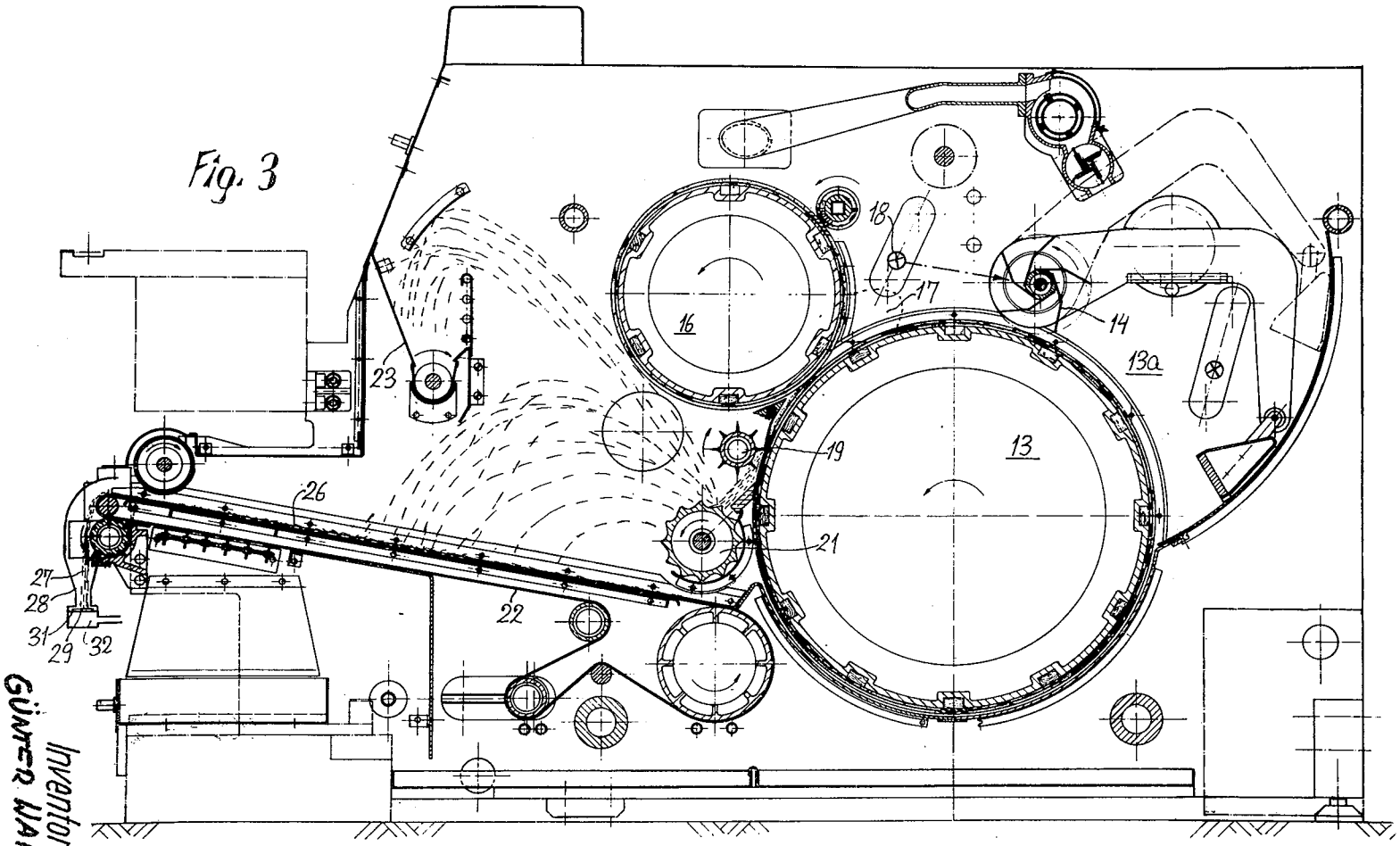
FIG. 3 is an enlarged vertical sectional view of a tobacco stream forming device in the machine of FIG. 2.

Certain details of the cigarette rod making machine 1 are shown in FIGS. 2 and 3. The FIG. 3 illustrates the details of a tobacco stream forming unit or distributor which forms part of the machine 1 and serves to produce a continuous narrow stream which consists of tobacco shreds and is ready to be wrapped into a web 39 of cigarette paper to form a continuous wrapped filler rod 48 which is thereupon severed by the cutoff 49 to yield plain cigarettes of unit length. The distributor of FIG. 3 comprises a carded drum 13 which draws shredded tobacco from a magazine 13*a* and transports a continuous layer of tobacco shreds past a first rotary refuser 14 which is provided with paddles or vanes and thereupon past a second rotary refuser 16 of the type known as combing drum and serving to remove from the carding of the drum 13 a surplus of shredded tobacco whereby such surplus forms a supply 17. The quantity of shreds in the supply 17 is determined by a detector 18 (preferably a photoelectric detector) which produces signals serving to cause appropriate adjustments in the position of the first refuser 14 so that the refuser 14 permits a thicker layer of shreds to move toward the second refuser 16 when the supply 17 contains less than a predetermined quantity of shreds and that the refuser 14 moves closer to the drum 13 to thus reduce the thickness of the layer of shreds which advance toward the second refuser 16 when the quantity of shreds in the supply 17 exceeds a predetermined value.

The second refuser 16 is mounted upstream of a driven picker roller 19 which removes the shreds from the carding of the drum 13 and causes the thus removed shreds to impinge against a driven winnower 21. The winnower 21 constitutes a means for automatically classifying the shreds according to their weight and for spreading tobacco shreds of satisfactory weight onto the upper stretch of an endless belt 22. The heavier (unsatisfactory) shreds are propelled into an intercepting receptacle 23 and are withdrawn from the bottom zone of such receptacle by a rotating screw or another suitable conveyor. The shreds which descend onto the belt 22 form thereon a wide carpet or silver 26 which is showered at the left-hand end of the upper stretch of the belt 22. The shower 27 descends in a confining chute 28 and onto a narrow band 29 which moves lengthwise (at right angles to the plane of FIG. 3) to accumulate thereon a narrow filler stream. The band 29 consists of foraminous material and its upper stretch travels along a perforated top wall 31 forming part of a suction chamber 32 which is connected to a suction generating device (not shown) and attracts the shreds to the upper stretch of the band 29.

The receptacle 23 inercepts fragments of stem, ribs, so-called birds' eyes, metallic particles and/or other relatively heavy parts which should be segregated from satisfactory shreds, namely, from those shreds which are to form the filler stream on the band 29.

Referring to FIG. 2, it will be seen that the upper stretch of the band 29 transports the filler stream to the circumferential groove of a suction wheel 33 wherein the shreds are held by suction and which conveys the stream past a suitable equalizing device or trimmer 34 which removes the surplus so as to convert the filler stream into a filler rod 36. The bottom wall of the circumferential groove of the suction wheel 33 is perforated and travels along a stationary suction chamber (now shown) which extends from the transfer point between the band 29 and suction wheel 33 to the transfer point where the filler rod 36 leaves the suction under the action of a tongue-like separating device 37 to be transported by a suction belt 38 and to enter a wrapping mechanism. The wrapping mechanism is provided with means for wrapping the filler rod 36 into a continuous web 39 of cigarette paper which is being withdrawn from a supply bobbin 41 and passes through an imprinting mechanism 42. The web 39 then advances below the separating device 37 and onto the wrapper stretch of a constantly driven garniture tape 43 of the wrapping mechanism. The web 39 is gradually convoluted or folded around the filler rod 36 by a device 44 which leaves one marginal portion of the web 39 exposed so that such marginal portion receives a coat of adhesive while advancing along a paster 46. The thus coated marginal portion is folded over the other marginal portion of the web 39 so that the latter is converted into a tubular wrapper which surrounds the filler rod 36 and forms therewith a continuous wrapped filler rod 48 which moves lengthwise toward the cutoff 49. The seam between the overlapping marginal portions of the web 39 is heated by a sealer 47 which is mounted upstream of the cutoff 49. The latter severs the rod 48 at regular intervals to convert it into a single file of plane cigarettes which are caused to advance along a so-called kicker 51 to be propelled into successive flutes of the conveyor 3. The kicker 51 is a driven cam whose lobes accelerate successive plain cigarettes so as to insure that each plain cigarette can enter a separate flute of the conveyor 3.

The web 39 advances through a splicing mechanism 53 which is shown in the lower left-hand portion of FIG. 2 and comprises two rotary splicing rollers 54, 56 adapted to roll a so-called pressure splice between the trailing portion of the running or expiring web 39 and the leading portion of a fresh web 39*a* which is stored on a fresh supply bobbin 41*a*. The lower splicing roller 56 is movable upwardly toward the upper splicing roller 54 in response to a signal from a detector 57 which scans the supply bobbin 41 and produces a signal when the diameter of the bobbin 41 decreases below a predetermined value which is indicative that the supply of running web 39 is about to expire. The signal from the detector 57 causes a short-lasting energization of an electromagnet 58 which serves to lift the splicing roller 56. As shown in FIG. 2, the tip of the leading end of the fresh web 39*a* must be placed onto the top part of the peripheral surface of the splicing roller 56 so that such tip is spliced to the adjacent portion of the expiring web 39 when the electromagnet 58 is energized in response to a signal from the detector 57. The fresh web 39*a* is accelerated during splicing and is thereupon drawn off the bobbin 41*a* at the rate required by the operating speed of the cigarette rod making machine 1. It is clear that the machine 1 can employ other types of splicers, for example, a splicer which attaches the leading end of a fresh web to the trailing end of an expiring web by means of an adhesive-coated uniting band or the like.

Figure 8:
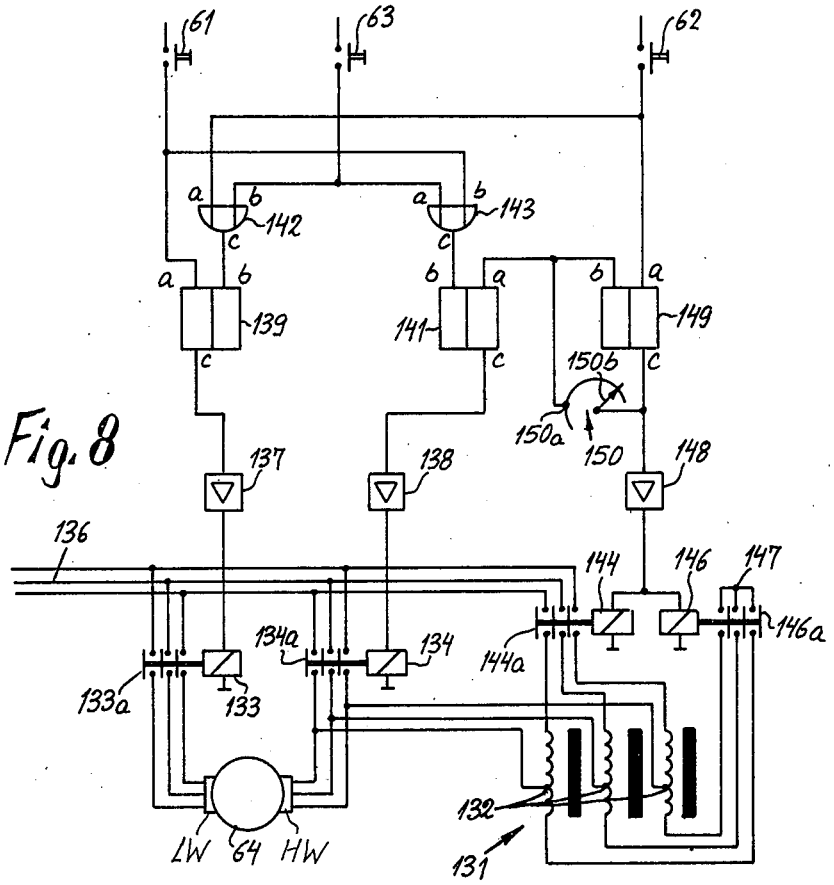
FIG. 8 is a diagram of a first control circuit which can be employed to regulate the speed of the prism mover for the producing machines of FIG. 1.

A control panel 59 which is mounted on the frame of the machine 1 (see the upper right-hand portion of FIG. 2) is provided with three actuating members or pushbuttons 61, 62, 63. As shown in FIG. 8, the pushbuttons are switches which can be closed by the operator to thereby produce signals serving to start the machine 1 and to cause operation of the machine 1 at a relatively low speed (pushbutton 61), to accelerate the machine 1 to its normal or higher operating speed (pushbutton 62) and to arrest the machine 1 (pushbutton 63). The prime mover of the machine 1 includes a variable-speed electric motor 64 (shown in FIGS. 2 and 8). As mentioned above, the motor 64 also drives the movable parts of the filter cigarette making machine 2 but not the packing machine 12. The machine 1 is the producing machine for the machine 2, and the machine 2 is the producing machine for the machine 12.

Figure 4:
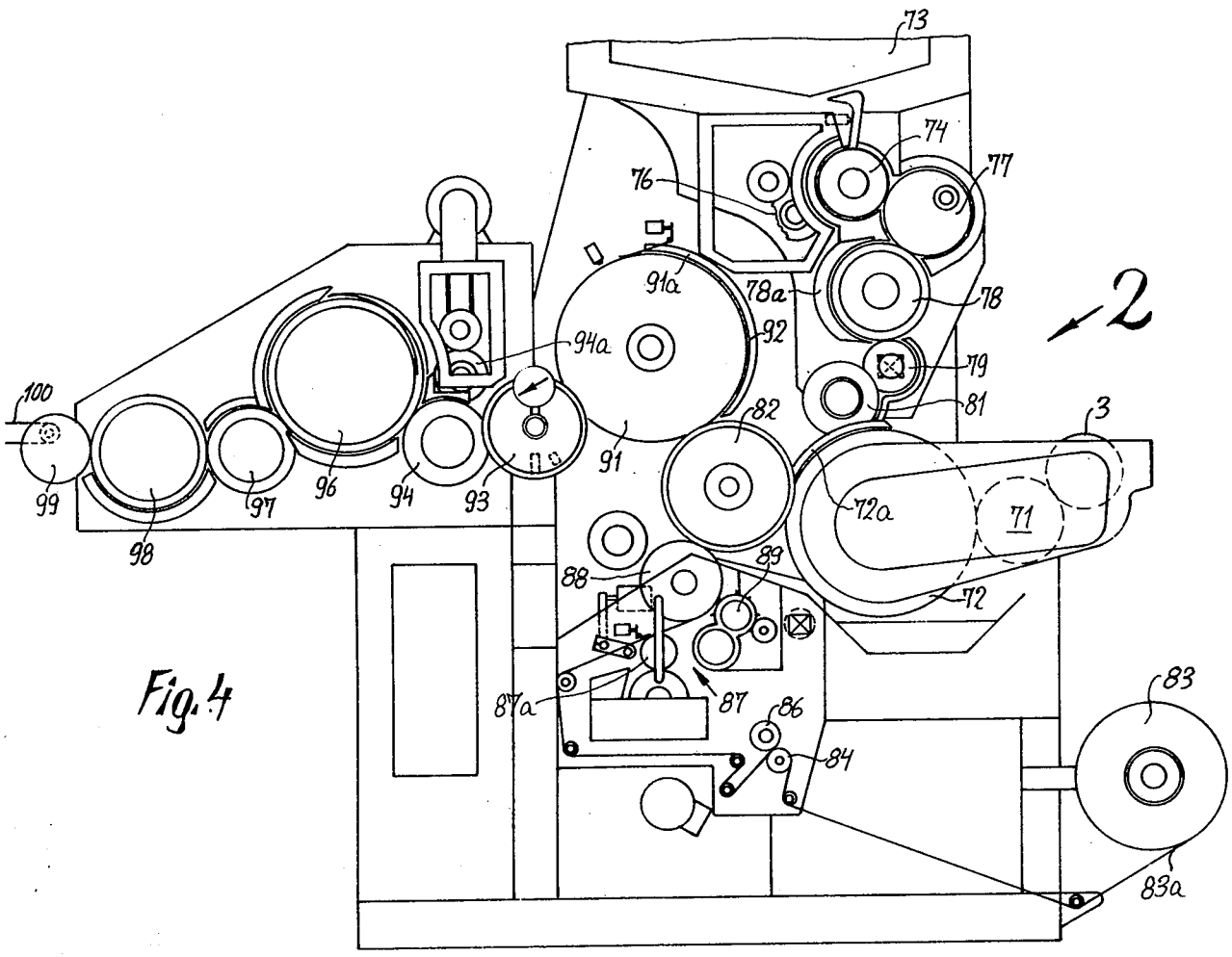
FIG. 4 is an enlarged elevational view of a filter cigarette making machine which constitutes the other producing machine of the production line shown in FIG. 1.

The essential component parts of the filter cigarette making machine 2 are illustrated in FIG. 4. The drum-shaped conveyor 3 of the machine 1 delivers two rows of plain cigarettes to a pair of aligning drums 71 (one shown) of the machine 2. The plain cigarettes in the flutes of the conveyor 3 travel sideways and the cigarettes of one row are staggered with reference to the cigarettes of the other row, as considered in the circumferential direction of the conveyor 3. The purpose of the aligning drums 71 is to place each plain cigarette of one row into axial alignment with a plain cigarette of the other row. The thus aligned pairs of plain cigarettes are transferred into successive flutes of an assembly drum 72 in such axial positions that the gap between the plain cigarettes of each pair is wide enough to accommodate, with at least some clearance, a filter rod section of filter plug of double unit length.

The machine 2 further comprises a magazine 73 for filter rod sections of six times unit length. The magazine 73 has an outlet which discharges filter rod sections of six times unit length into successive flutes of severing drum 74 which advances the sections along two coaxial disk-shaped rotary cutters or knives 76 serving to subdivide each filter rod section of six times unit length into a group of three coaxial filter rod sections or filter plugs of double unit length. The plugs of the thus obtained groups are accepted by three staggering drums 77 which have different diameters and/or rotate at different peripheral speeds so as to move each plug of a group out of axial alignment with the other two plugs of the same group. The thus staggered plugs are transferred into successive flutes of a shuffling drum 78 which cooperates with suitable cams 78*a* or the like to form a single row of plugs which travel sideways and enter successive flutes of a transfer drum 79. The latter delivers the plugs to an accelerating drum 81 which introduces the plugs into successive flutes of the assembly drum 72 in such a way that the plugs are flanked by pairs of coaxial plain cigarettes of unit length (which are delivered to the assembly drum 72 by the aforementioned aligning drums 71). The thus obtained groups (each of which contains two plain cigarettes and a filler plug between the plain cigarettes) advance along condensing cams 72*a* which move at least one plain cigarette of each pair toward the other plain cigarette of the respective pair so as to place the inner ends of the plain cigarettes into abutment with the adjacent ends of the respective filter plugs. The thus obtained condensed groups are transferred onto a further drum 82 which attaches to each condensed group an adhesive-coated uniting band in such a way that the band adheres to the respective filter plug and to the adjacent inner ends of the respective plain cigarettes.

The uniting bands are obtained in response to severing of an elongated web 83*a* which is being withdrawn from a bobbin 83 by a pair of advancing rolls 84, 86 and thereupon advances along a rotary applicator 87*a* in a paster 87 whereby the applicator 87*a* coats the underside of the web 83*a* with a suitable adhesive. The thus coated web 83*a* is then attracted to the periphery of a suction drum 88 which cooperates with the blades of a severing drum 89 to form discrete uniting bands which adhere to the periphery of the drum 82 or are attached directly to the corresponding condensed groups.

The condensed groups (each of which is provided with an adhesive-coated uniting band) are thereupon transferred from the drum 82 onto a rolling or wrapping drum 91 which advances the groups through an arcuate gap 92 between the drum 91 and a stationary rolling member 91*a*. The groups are caused to rotate about their axes during travel through the gap 92 whereby the uniting bands are convoluted around the respective filter plugs and around the adjacent inner ends of the respective plain cigarettes to convert each condensed group into a filter cigarette of double unit length. Such filter cigarettes of double unit length are transferred onto a testing drum 93 which comprises or cooperates with means for testing the integrity of the cigarettes and cooperates with suitable ejector means (not shown) serving to segregate defective cigarettes from satisfactory cigarettes. The cigarettes are normally tested for the presence or absence of holes or other defects in the wrappers of the plain cigarettes, for the presence or absence of holes or other defects in the wrappers consisting of convoluted uniting bands, and/or for the presence or absence of leaks between the inner ends of the plain cigarettes and the respective ends of the plugs.

Figure 6:
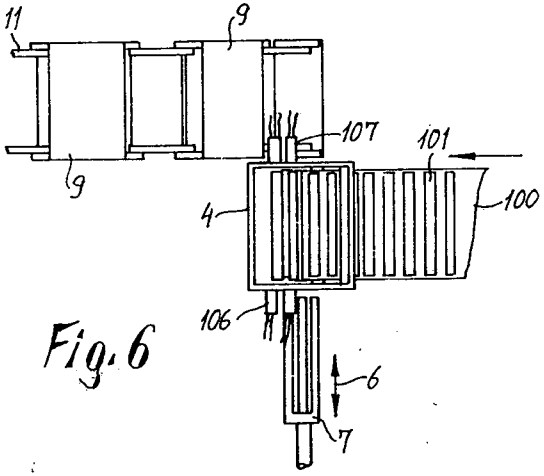
FIG. 6 is a plan view of the unit shown in FIG. 5.

The testing drum 93 delivers satisfactory filter cigarettes of double unit length into the flutes of a severing drum 94 which cooperates with a rotary disk-shaped knife 94*a* serving to sever each filter cigarette of double unit length midway across the filter plug of double unit length and to thus subdivide each such cigarette into two filter cigarettes of unit length. The thus obtained rows of filter cigarettes of unit length are transferred onto an inverting conveyor 96 which inverts the filter cigarettes of one row-end-for-end to insure that the filter plugs of all filter cigarettes face in the same direction. The illustrated inverting conveyor 96 is preferably constructed in such a way that it inverts the filter cigarettes of one row and simultaneously places the thus inverted filter cigarettes between the filter cigarettes of the other row so that the conveyor 96 can discharge a single row of filter cigarettes of unit length which move sideways and have filter plugs of unit length facing in the same direction. Such filter cigarettes are accepted by a transfer drum 97 which delivers them to a second testing drum 98 having or cooperating with means for testing the density of tobacco fillers at the free ends of the tobacco rod sections of successive filter cigarettes. The testing drum 98 has or cooperates with suitable ejector means serving to segregate defective filter cigarettes from satisfactory cigarettes. The satisfactory filter cigarettes are transferred onto a transfer conveyor 99 which delivers such cigarettes onto the upper stretch of an endless conveyor belt 100. As shown in FIG. 5 and 6, the filter cigarettes of unit length are denoted by the reference character 101. The belt 100 delivers the cigarettes 101 into the aforementioned magazine 4 which cooperates with the transfer member 7 to form arrays or blocks 8 of twenty filter cigarettes each.

The machine 2 is designed to turn out up to 4,000 filter cigarettes per minute (or even more). Thus, the moving parts of the machine 2 and of the producing machine 1 must be operated at very high speeds. Since articles (plain cigarettes and filter cigarettes) are quite sensitive, namely, subject to deformation, breaking, puncturing or wrappers and/or other defects, rapid changes in the speed of moving parts in the machines 1 and 2 should be avoided for obvious reasons. Rapid changes in the speed of moving parts can cause undesirable shifting of tobacco shreds in the silver, filler stream or filler rod, shifting of the web 39, 39*a* and/or 43*a*, and/or unpredictable movements of plain cigarettes, filter rod sections and/or filter cigarettes with reference to their conveyors. Shifting of tobacco shreds in response to rapid changes in the speed of parts on which the shreds are transported is particularly likely in those portions of the machine 1 where the shreds are not held by suction. The same applies for the movements of wrapped cigarette rod or filter rod sections and filter cigarettes. Furthermore, rapid changes in the speed of certain parts are likely to cause tearing of the cigarette paper web 39 or 39*a* and/or tearing of the web 43*a* which yields adhesive-coated uniting bands. Still further, such rapid changes in the speed of certain parts can cause excessive coating with adhesive or unsatisfactory coating with adhesive, unsatisfactory heating and sealing of seams between overlapping marginal portions of the web 39 and/or uniting bands, and other inconveniences which necessitate a stoppage of the machines 1, 2 with attendant losses in output and/or ejection of substantial numbers of defective articles. The manner in which excessive acceleration and/or deceleration of moving parts in the machines 1 and 2 can be avoided in accordance with a feature of the present invention will be described in connection with FIG. 8 following description of certain parts of the packing machine 12.

As mentioned in connection with FIGS. 5 and 6, the chain conveyor 11 serves to deliver arrays 8 of filter cigarettes 101 to the packing machine 12. The sprocket wheel 104 is assumed to be driven in stepwise fashion at a frequency which is determined by the requirements of the packing machine 12. The same holds true for the mechanism (not shown) which reciprocates the transfer member 7 to expel arrays 8 into the registering cells 9 of the conveyor 11. The packing machine 12 has a turret provided with chambers (not shown) which register with successive cells 9 of the conveyor 11 and receive therefrom arrays 8 for transport toward the station or stations where the arrays are introduced into envelopes. The resulting packs are normally provided with revenue stamps and are preferably enclosed in transparent outer envelopes having customary tear strips.

The supply of filter cigarettes 101 in the magazine 4 is scanned by a lower detector 107 and an upper detector 106. These detectors are preferably photoelectric detectors of the type having a light source mounted in one wall of the magazine 4 and a light sensitive element (which may comprise a cadmium cell or the like) mounted in the opposite wall of the magazine. The upper detector 106 is designed to produce a signal when the light beam issuing from its light source cannot reach the respective light sensitive element, and the lower detector 107 is designed to produce a signal when the light beam issuing from its light source can reach the respective light sensitive element. The signals produced by the light sensitive elements of the detectors 106, 107 serve to regulate the operation of the machine 1 in a manner which will be described in connection with FIG. 8.

Figure 7:
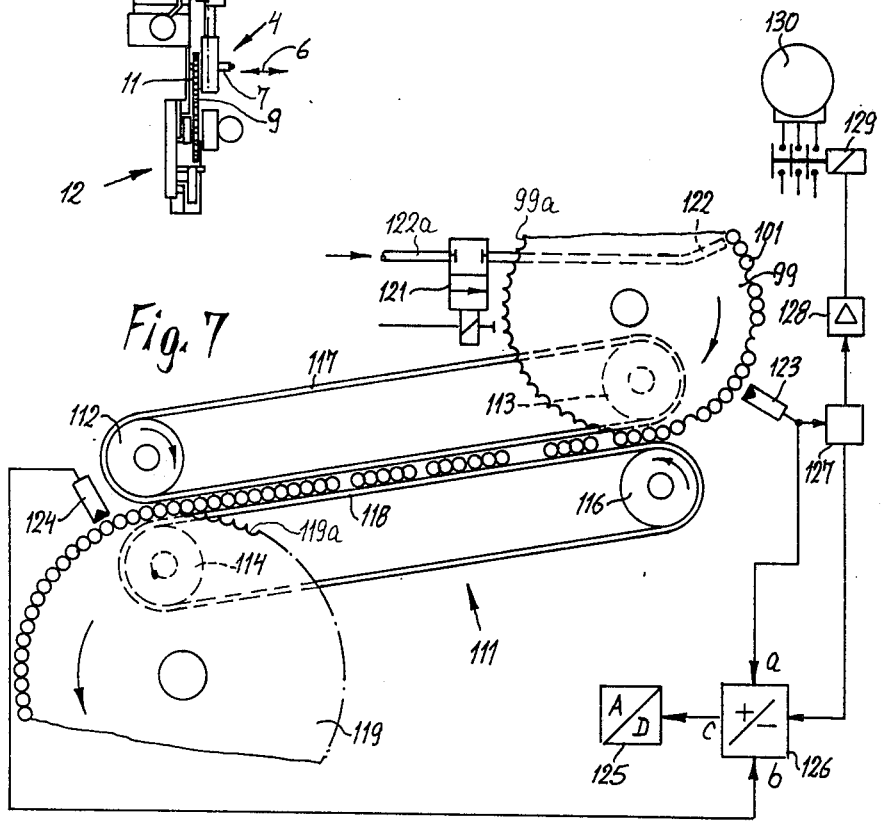
FIG. 7 is a side elevational view of a modified block-forming unit which can be utilized as a substitute for the unit shown in FIGS. 5 and 6.

FIG. 7 illustrates a modified array- or block-building unit which can be used as a substitute for the unit shown in FIGS. 5 and 6. The transfer conveyor 99 of the filter cigarette making machine 2 has axially parallel peripheral flutes 99*a* wherein the cigarettes 101 are held by suction during transfer from the testing drum 98 (not shown in FIG. 7) into a relatively small intermediate magazine 111 formed by two endless belts 117, 118. The magazine includes a downwardly inclined channel which is flanked by the lower stretch of the upper belt 117 and by the upper stretch of the lower belt 118. The belts 117, 118 are respectively trained over pairs of rollers 112, 113 and 114, 116. At least one of each pair of rollers is driven in a direction as indicated by arrows applied to the rollers 112 and 116. The cigarettes 101 which are discharged from the channel of the magazine 111 are accepted by the first fluted drum-shaped conveyor 119 of a conveyor system which can convert the single row of closely adjacent filter cigarettes 101 in the flutes of the conveyor 119 into arrays 8 or other types of arrays, depending on the desired number of cigarettes in each pack and on the position of cigarettes in each array with reference to each other. The purpose of the magazine 111 is to insure that the conveyor 119 can receive a continuous row of closely adjacent cigarettes 101 irrespective of the rate at which the channel of the magazine 111 receives cigarettes from the transfer conveyor 99. The remaining conveyors of the system which includes the conveyor 119 serve to remove from the single row of cigarettes 101 of the conveyor 119 discrete layers of cigarettes which are thereupon introduced into the pockets of an endless chain conveyor or the like so that each pocket accumulates a complete array. The details of such conveyor system are shown and disclosed, for example, in Italian patent No. 835,531. The arrangement is such that the conveyors which remove layers of cigarettes 101 from the conveyor 119 remove all of the cigarettes from the flutes 119*a* so that such flutes are ready to receive fresh cigarettes 101 when they reach the discharge end of the channel between the belts 117 and 118. The conveyors of the system including the conveyor 119 are preferably driven continuously in contrast to the chain conveyor 11 of the unit shown in FIGS. 5 and 6 which is assumed to be driven in stepwise fashion.

In the embodiment of FIG. 7, the testing means including the testing drum 98 of FIG. 4 is assumed to transmit signals to a pneumatic ejector including a nozzle 122 adjacent to the transfer conveyor 99 at the 2 o'clock position and receiving compressed air or another gaseous fluid by way of a supply conduit 122*a* which contains an electromagnetically operating valve 121. The valve 121 opens whenever the scanning mechanism of the testing means including the drum 98 detects a defective cigarette 101 but with such a delay that the stream of compressed fluid issuing from the nozzle 122 is discharged at the exact moment when the defective cigarette 101 registers with the nozzle 122. The defective cigarettes 101 are ejected into a suitable collecting receptacle, not shown. Due to placing of the ejector nozzle 122 adjacent to the path of cigarettes 101 on the transfer conveyor 99, the latter is likely to deliver into the channel between the belts 117, 118 filter cigarettes 101 at irregular intervals, for example, a group of four closely adjacent cigarettes, followed by a single cigarette, and so on, depending on the frequency at which the testing means including the drum 98 detects defective articles.

A photoelectric detector 123 is adjacent to the path of cigarettes 101 on the conveyor 99 close to the inlet of the channel between the belts 117, 118. The detector 123 is of the type which emits a beam of light to be reflected by the cigarettes 101 onto a light sensitive element of the detector 123 so that the latter produces an electric signal which is transmitted to the input *a* of a forward-rearward recorder or counter 126. Thus, the counter 126 receives a "positive" signal whenever the detector 123 detects a filter cigarette 101 on its way into the intermediate magazine 111. A second photoelectric detector 124 which is similar to the detector 123 is mounted adjacent to the conveyor 119 downstream of the discharge end of the magazine 111. The detector 124 transmits signals to a second input *b* of the counter 126. The signals from detector 124 are "negative" signals, i.e., each such signal erases a signal which is transmitted to the input *a* by the detector 123. The ratio of positive to negative signals is indicated as a digital electric voltage at the output *c* of the counter 126 which is connected to a digital-analog converter circuit 125 of known design. The magnitude and sign of the output voltage from the converter circuit 125 are indicative of the number of defective cigarettes 101 which were segregated by the ejector nozzle 122. Otherwise stated, the output signal from the converter circuit 125 is indicative of the number of those cigarettes 101 which are produced in the machine 2 but do not reach the packing machine 12. Such signal can be used to regulate the speed of the cigarette rod making machine 1.

The detector 123 further transmits signals to an auxiliary register or counter 127 which is adjustable to produce an output signal in response to reception of a predetermined number of signals from the detector 123. The auxiliary counter 127 then transmits a signal to and activates the counter 126, and to an amplifier 128 which energizes a relay 129 in the circuit of the electric motor 130 of the packing machine 12. The motor 130 drives the moving parts of the packing machine 12 and also the conveyor system including the conveyor 119. Thus, the conveyor system assembles arrays or blocks of filter cigarettes 101 at the rate which is determined by the speed of the packing machine 12. This insures that the packing machine 12 produces an empty pack for each such array.

FIG. 8 illustrates a control circuit for the variable-speed electric motor 64 which drives the movable parts of the machines 1 and 2. This motor is a reversible-pole polyphase synchronous motor. The speed varying means for supplying electrical energy to the motor 64 at a certain stage of the operation comprises a three-stage transformer 131. FIG. 8 further shows the aforementioned pushbuttons 61, 62 and 63. The transformer 131 has taps 132 which are connected to the high-RPM winding HW of the motor 64. The numerals 133, 134 denote motor relays which have contacts 133*a*, 134*a* respectively installed in the low-RPM winding LW and high-RPM winding HW of the motor 64 and serving to connect the respective windings with a source of polyphase current by way of leads 136. The relays 133, 134 are respectively energizable by amplifiers 137, 138. These amplifiers receive voltage from the outputs *c* of signal storing devices or circuits 139, 141. The signal storing devices 139, 141 have setting inputs *a* and signal erasing inputs *b*. The nature of the signal storing devices 139, 141 is such that the transmission of a signal to the input *a* results in emission of a signal at the output *c*, and the emission of such signal continues even if the transmission of signal to the input *a* is terminated. The output *c* of the signal storing device 139 or 141 ceases to emit a signal in response to reception of a signal at the respective input *b*.

The control circuit of FIG. 8 further comprises two logical circuits in the form of OR-gates 142, 143 having outputs *c* which emit signals as long as at least one of their inputs *a*, *b* receives a signal. Still further, the control circuit comprises relays 144, 146 having contacts 144*a*, 146*a*. The contacts 144*a* serve to connect two windings of the transformer 131 with the leads 136, and the contacts 146*a* serve to shortcircuit the neutral point 147 of the transformer 131. The numeral 148 denotes an amplifier which can energize the relays 144, 146 and is connected with the output *c* of a third signal storing device or circuit 149 as well as with the adjustable wiper arm 150b of a potentiometer 150 which constitutes a timer and has a contact 150a serving to respectively transmit signals to the inputs *a* and *b* of the signal storing devices 141 and 149 when engaged by the wiper arm 150b.

The operation of the control circuit of FIG. 8 is as follows:

If the operator wishes to start the machines 1 and 2, the pushbutton 61 is depressed to transmit a signal to the input *a* of the signal storing device 139 and an erasing signal to the input *b* of the signal storing device 141. The input *b* of the signal storing device 141 receives a signal from the output *c* of the OR-gate 154 because a depression of the push-button 61 results in transmission of a signal to the input *b* of the OR-gate 143. The output *c* of the signal storing device 139 transmits a signal to the amplifier 137 which energizes the relay 133 so that the switches 133a connect the low-RPM winding LW of the motor 64 with the leads 136. The output *c* of the signal storing device 139 continues to tramsmit a signal to the amplifier 137 after the finger pressure upon the pushbutton 61 is relaxed because of the aforedescribed construction of the device 139. The motor 64 is started and is gradually accelerated to a relatively low speed.

If the operator thereupon wishes to increase the RPM of the motor 64, the pushbutton 62 is depressed to transmit a signal to the erasing input *b* of the signal storing device 139 by way of the OR-gate 142 whose output *c* emits a signal in response to transmission of a signal to at least one of its inputs *a* and *b*. The output *c* of the signal storing device 139 ceases to emit a signal so that the relay 133 is deenergized and opens its contacts 133a to thus disconnect the low-RPM winding LW of the motor 64 from the leads 136. At the same time, the pushbutton 62 transmits a signal to the input *a* of the signal storing device 149 whose output *c* starts to emit a signal and continues to emit a signal after the finger pressure upon the pushbutton 62 is relaxed or terminated. The output signal of the signal storing device 149 is amplified at 148 and serves to energize the relays 144 and 146. These relays close their respective contacts 144a, 146a so that the high-RPM winding HW of the motor 64 is connected with taps 132 of the transformer 131 whereby the high-RPM winding HW receives a voltage which is less than the voltage needed to operate the motor 64 at a full or normal speed. The motor 64 is gradually and smoothly accelerated in accordance with a curve which is a function of time and is selected in such a way that the acceleration is less than if the high-RPM winding HW of the motor 64 were connected directly with the leads 136. The signal which is emitted by the output *c* of the signal storing device 149 starts the timer 150 so that the wiper arm 150b begins to rotate in a counterclockwise direction, as viewed in FIG. 8, and advances toward the contact 150a at a predetermined speed to reach the contact 150a with a delay which is determined by the initial setting of the wiper arm 150b. Upon elapse of such delay, i.e., when the arm 150b reaches the contact 150a, the timer 150 transmits a signal to the erasing input *b* of the signal storing device 149 which deenergizes the relays 144, 146 whereby the contacts 144a, 146a open so that the high-RPM winding HW of the motor 64 is disconnected from the taps 132 of the transformer 131.

The timer 150 also transmits a signal to the input *a* of the signal storing device 141 which causes the amplifier 138 to energize the relay 134 whereby the contacts 134a connect the high-RPM winding HW of the motor 64 directly with the leads 136. Thus, the motor 64 is operated at the higher or normal speed which is required for normal operation of the machines 1 and 2. The slight acceleration of motor 64 in response to energization of the relay 134 takes place gradually in order to avoid a sudden increase in the speed of parts which receive motion from the motor 64.

When the person in charge wishes to arrest the motor 64, the pushbutton 63 is depressed to transmit a signal to the erasing input *b* of the signal storing device 141 (by way of the OR-gate 143) whereby the amplifier 138 deenergizes the relay 134 to open the contacts 134a. The motor 64 is disconnected from the leads 136 and is gradually decelerated to zero speed.

If the person in charge wishes to arrest the motor 64 prior to actuation of the pushbutton 62 but subsequent to actuation of the pushbutton 61, the pushbutton 63 is depressed to deenergize the relay 133 and to open the contacts 133a by way of the OR-gate 142 which transmits a signal to the erasing input *b* of the signal storing device 139 so that the latter deenergizes the relay 133 by way of the amplifier 137.

Figure 9:
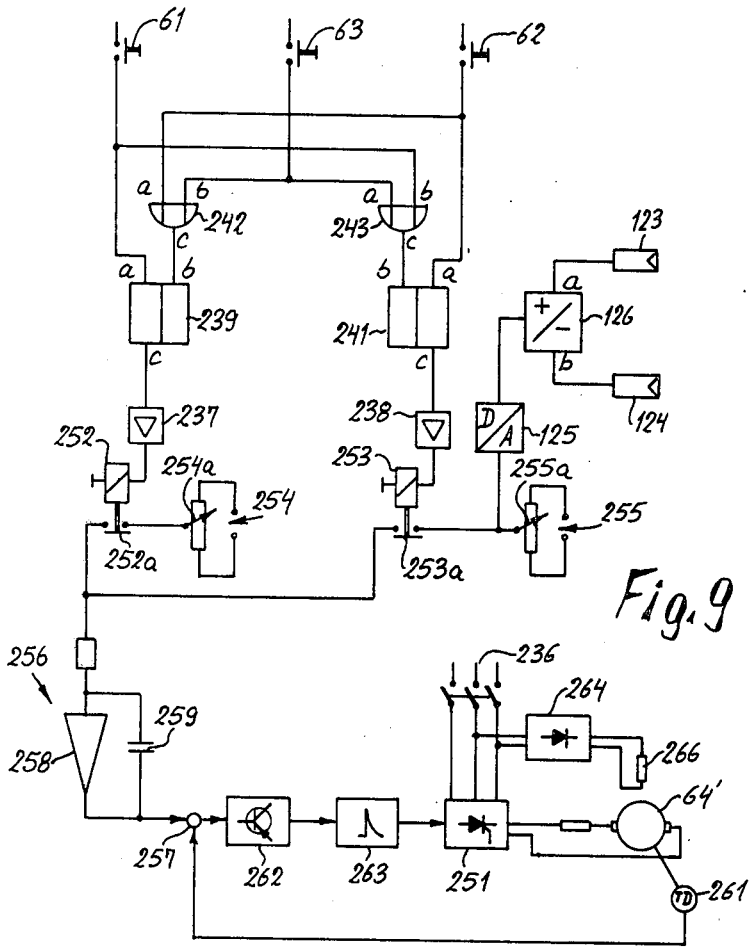
FIG. 9 is a diagram of a second control circuit which can be used as a substitute for the control circuit of FIG. 8.

FIG. 9 illustrates a second control circuit which can be used as a substitute for the control circuit of FIG. 8 and serves to regulate the operation of a motor 64' replacing the motor 64. The motor 64' is a direct-current motor which can be regulated by way of armature current. The speed-varying transformer 131 of FIG. 8 is replaced with a d-c amplifier 251 which regulates the voltage of the motor 64' and is shown in the form of thyristor amplifier. A suitable thyristor amplifier is sold by the West German Firm AEG under the name "MINISEMI". The input of the thyristor amplifier 251 is connectable with a source of polyphase current by way of leads 236. The signal storing devices 239, 241, the OR-gates 242, 243 and the amplifiers 237, 238 of the control circuits shown in FIG. 9 are identical with the similarly numbered parts 139, 141, 142, 143, 137, 138 in the control circuit of FIG. 8. The amplifiers 237, 238 can energize relays 252, 253 having contacts 252a, 253a. When the contacts 252a are closed on energization of the relay 252, a signal comparing junction 257 is connected with a potentiometer 254 by way of a time delay circuit 256. When the amplifier 238 causes the relay 253 to close its contacts 253a, the junction 257 is connected with a second potentiometer 255 by way of the time delay circuit 256. The potentiometers 254, 255 have adjustable wiper arms 254a, 255a and constitute two calibrating means. The setting of the wiper arm 254a determines the RPM of the motor 64' when the latter is operated at the lower of two speeds, and the setting of the wiper arm 255a determines the lowest RPM of the motor 64' when the motor is operated at the higher or normal speed. The junction 257 is further connected with an output shaft speed sensor here shown as a tachometer generator 261 which is connected with the motor 64' and transmits to the junction 257 signals which are indicative of the momentary speed of the motor 64'. The output of the junction 257 is connected with the input of an electronic amplifier 262; this output transmits output signals which are indicative of the difference between the momentary speed of the motor 64'(as determined by the tachometer generator 261) and the desired RPM (as indicated by the signal which is transmitted by the time delay circuit 256). The thyristor amplifier 251 receives signals from the amplifier 262 by way of a pulse shaper 263. The control circuit of FIG. 9 further comprises a rectifier 264 which supplies d-c current to the energizing winding 266 of the motor 64'.

The time delay circuit 256 comprises an operational amplifier 258 which is connectd in parallel with a capacitor 259. The forward-rearward recorder or counter 126 of FIG. 7 (which receives signals from the detectors 123, 124) is connected in parallel with the potentiometer 255 and in series with the digital-analog converter circuit 125. The counter 126 and the circuit 125 can influence the desired value of RPM of the motor 64'. It will be noted that the control circuit of FIG. 9 can regulate the operation of the motor 64' in dependency on the actuation of pushbuttons 61, 62, 63 as well as in dependency on the condition of a processing machine (packing machine 12).

The operation of the control circuit of FIG. 9 is as follows:

When the person in charge depresses the pushbutton 61 to start the motor 64' (which drives the movable parts of the machines 1 and 2), the input *a* of the signal storing device 239 receives a signal and its output *c* transmits a signal to the amplifier 237 which energizes the relay 252 to close the contacts 252*a*. The output *c* of the signal storing device 239 continues to emit a signal which energizes the relay 252 after the pushbutton 61 reassumes the illustrated idle position. The wiper arm 254*a* of the potentiometer 254 is connected with the junction 257 by way of the time delay circuit 256 whereby the selected position of the wiper arm 254*a* determines the RPM of the motor 64' when the latter is to operate at the lower of two speeds. The purpose of the time delay circuit 256 is to prevent abrupt transmission of the full signal from the potentiometer 254 to the junction 257; the circuit 256 insures gradual intensification of such signal whereby the intensity of signal which the junction 257 transmits to the amplifier 262 rises gradually. Thus, the amplifier 251 transmits to the motor 64' a signal which causes a gradual and smooth increase in the RPM to a value determined by setting of the wiper arm 254*a*. The tachometer generator 261 transmits to the junction 257 a signal which is indicative of the actual RPM of the motor 64', and the gradual acceleration of the motor is terminated when the signal from the tachometer generator 261 indicates an RPM which has been selected by setting of the wiper arm 254*a*.

Once the motor 64' drives the parts of the machines 1 and 2 at the selected lower speed, the person in charge may wish to increase the RPM to the normal operating speed. This is achieved by depressing the pushbutton 62 which causes a gradual acceleration of the motor 64' to that speed which is determined by the selected setting of wiper arm 255*a*. The pushbutton 62 transmits a signal to the input *a* of the OR-gate 242 which transmits a signal to the erasing input *b* of the signal storing device 239 whereby the latter deenergizes the relay 252 which opens its contacts 252*a* to disconnect the potentiometer 254 from the junction 257. The pushbutton 62 further transmits a signal to the input *a* of the signal storing device 241 which energizes the relay 253 by way of the amplifier 238 so that the relay 253 closes its contacts 253*a* and connects the junction 257 with the wiper arm 255*a* of the potentiometer 255. The signal from the potentiometer 255 to the junction 257 is gradually intensified by the time delay circuit 256, and the junction 257 transmits to the amplifier 262 a signal which is indicative of the difference between the desired higher RPM and the momentary RPM of the motor 64'. Thus, the voltage at the output of the d-c amplifier 251 rises gradually and the motor 64' is gradually accelerated to a higher RPM which, however, is below the maximum RPM. The time delay circuit 256 again insures that the acceleration of motor 64' from the lower to the higher RPM takes place gradually. The circuit 256 further insures that the motor 64' is decelerated gradually in response to depression of the pushbutton 63 or 61.

The signal which the junction 257 receives by way of the contacts 253*a* of the relay 253 can be influenced by the counter 126, and more particularly by the digital-analog converter circuit 125. As the filter cigarettes 101 move past the detector 123 of FIG. 7, the detector transmits signals to the auxiliary counter 127. The counter 126 is inactive because it is activated by the auxiliary counter 127 when the latter receives a predetermined number of signals from the detector 123. Such predetermined number of signals indicates the number of filter cigarettes 101 in the magazine 111 of FIG. 7. The auxiliary counter 127 then energizes the relay 129 by way of the amplifier 128 whereby the relay 129 completes the circuit of the motor 130 (FIG. 7) for the packing machine 12. Thus, the conveyor 119 of FIG. 7 begins to withdraw a continuous row of closely adjacent equidistant cigarettes 101 from the channel between the belts 117, 118 of the magazine 111.

The auxiliary counter 127 also activates the counter 126 by transmitting a signal to the input *a*. The input *b* of the counter 126 receives signals from the detector 124 which counts the cigarettes 101 on the conveyor 119. If the transfer conveyor 99 receives satisfactory filter cigarettes 101 at a maximum rate (i.e., if the nozzle 122 does not eject any cigarettes from the adjacent flutes 99*a*), the number of cigarettes 101 which enter the channel between the belts 117, 118 equals the number of cigarettes 101 which are being withdrawn during a given interval of time by the conveyor 119. The setting of the counter 126 remains unchanged (zero setting) and the digital-analog converter circuit 125 does not emit a signal. However, if the row of cigarettes 101 which pass along the detector 123 contains gaps (due to ejection of unsatisfactory cigarettes by the nozzle 122), the counter 126 produces a "negative" signal and the circuit 125 transmits an appropriate signal which is superimposed upon the signal (voltage) from the potentiometer 255. The junction 257 receives a signal which causes the amplifier 251 to gradually increase the RPM of the motor 64' in order to compensate for defective cigarettes 101 which are removed by the nozzle 122. The acceleration of motor 64' is gradual due to the provision of the time delay circuit 256. The number of cigarettes 101 which are detected by the detector 123 increases so that the setting of the counter 126 returns to zero. This takes place when the supply of cigarettes 101 in the magazine 111 is replenished to the predetermined value. The voltage at the output of the amplifier 251 decreases because the circuit 125 ceases to superimpose a signal on the signal from the potentiometer 255 so that the speed of the motor 64' gradually decreases to that which is determined only by the selected position of wiper arm 255*a*. The number of filter cigarettes 101 which are produced by the machines 1 and 2 per unit of time then equals the number of cigarettes which are withdrawn from the magazine 111 by the conveyor 119.

It will be noted that the control circuit of FIG. 9 insures gradual and smooth acceleration of the motor 64′ to its lower operating speed, to the lower limit of its normal or higher operating speed, beyond such lower limit of the normal or higher operating speed, back to the lower limit of the normal operating speed, from such lower limit of the normal operating speed to the lower operating speed, and from the lower operating speed to zero. The speed of the motor 64′ can be regulated in response to actuation of the pushbuttons 61, 62, 63 and also in response to changes in the condition of one or more machines which receive the output of the machines 1 and 2. In the present case, such changes in the condition involve a change in the quantity of articles 101 which are stored in the auxiliary magazine 111 of the packing machine 12. Thus, the (processing or consuming) machine 12 can regulate the output of the producing machines 1 and 2. It is clear that the means 123, 124, 125, 126, 127 which influence the speed of the motor 64′ can be replaced with other means, for example, with a means which adjusts the speed of the motor 64′ in response to changes in the condition of another unit in the packing machine 12, such as the mechanism which forms the envelopes for reception of arrays 8, the mechanism which transfers arrays 8 into open-ended envelopes, and/or other mechanisms of the machine 12.

Figure 10:
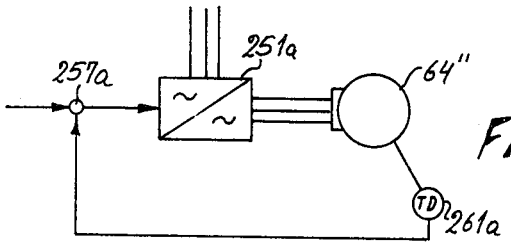
FIG. 10 illustrates a detail of a third control circuit which constitutes a modification of the control circuit shown in FIG. 9.

The control circuit of FIG. 10 differs from the control circuit of FIG. 9 in that the motor 64′ is replaced with a polyphase synchronous motor 64″ having a cage rotor and that the d-c amplifier 251 of FIG. 9 is replaced with an energy supplying or speed varying means in the form of a conventional frequency changer circuit 251*a* adapted to change the frequency and voltage of current supplied to the motor 64″. An advantage of the control circuit which is shown in FIG. 10 is that the motor 64″ is particularly sturdy because it need not employ parts which are subject to considerable wear (such as slip rings, brushes) and can be airtightly enclosed or encapsulated to thus prolong the useful life of sensitive parts. Airtight sealing of the motor parts is particularly important in cigarette rod making machines due to generation of tobacco dust which is likely to affect the operation of sensitive parts. The frequency changer circuit 251*a* receives signals from a signal comparing junction 257*a* which is analogous to the junction 257 of FIG. 9. The junction 257*a* receives signals from the tachometer generator 261*a* and from the component 254 or 255, 125 (not shown in FIG. 10). Thus, the RPM of the motor 64″ can be changed at the will of the operator (by actuating the pushbutton 61, 62 or 63) as well as in response to changes in the condition of one or more units in the machine (12) which receives the output of those machines whose movable parts are driven by the motor 64″.

Figure 11:
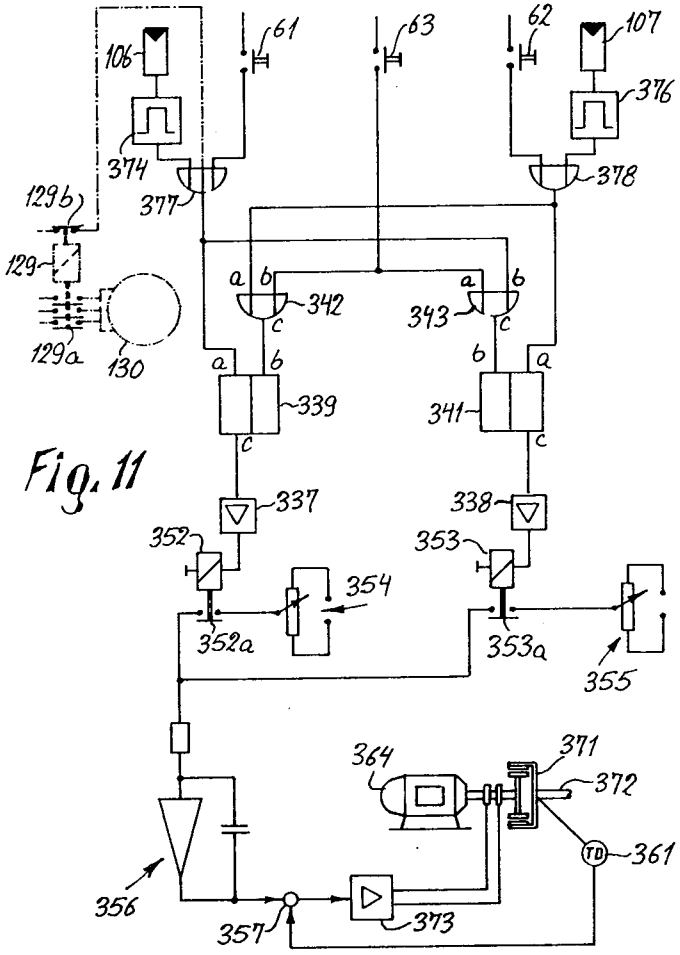
FIG. 11 is a diagram of a fourth control circuit for the production line of FIG. 1.

The control circuit of FIG. 11 constitutes a further modification of the control circuits shown in FIGS. 8, 9 and 10. The main difference between the control circuits of FIGS. 9 and 11 is that the latter employs a prime mover including infinitely variable torque-transmitting means in the form of an electrically operated clutch 371 which is installed between an electric motor 364 of the prime mover and an input shaft 372 of the cigarette rod making machine 1. The motor 364 is assumed to be a polyphase synchronous motor. The construction of the clutch 371 is such that it can transmit to the shaft 372 torque of varying magnitude to thereby influence the RPM of the input shaft 372. The parts 342, 343, 339, 341, 337, 338, 352, 353, 354, 355, 356, 357, 361 of the control circuit shown in FIG. 11 are identical with or clearly analogous to the parts 242, 243, 239, 241, 237, 238, 252, 253, 254, 255, 256, 257, 261 of the control circuit of FIG. 9. The numeral 373 denotes a d-c output amplifier. The control circuit of FIG. 11 further includes the photoelectric detectors 106, 107 of FIGS. 5 and 6, i.e., the filter cigarette making machine 2 which is driven by the shaft 372 is assumed to be provided with the reciprocable transfer member 6 which replaces the unit including the conveyor 119 of FIG. 7. The detectors 106, 107 are respectively connected in parallel with the pushbuttons 61 and 62. The control circuit of FIG. 11 further comprises pulse shapers 374, 376 which are connected between the light sensitive elements of the detectors 106, 107 and one input of the OR-gates 377, 378. It will be seen that the control circuit of FIG. 11 is designed to regulate the RPM of the input shaft 372 in dependency on the desired speed (as selected by the pushbuttons 61, 62, 63) as well as in dependency on the condition of a unit (the structure of FIGS. 5 and 6) in that machine (filter cigarette making machine 2) which receives the output of the cigarette rod making machine 1. It will be recalled that the detectors 106, 107 respectively emit signals when the supply of filter cigarettes 101 in the magazine 4 decreases below or increases above a predetermined minimum or maximum level.

The operation of the control circuit of FIG. 11:

The machines 1 and 2 are started in response to actuation of the pushbutton 61 which transmits a signal to the input *a* of the signal storing device 339 by way of the OR-gate 377. The output *c* of the signal storing device 339 emits a signal which is amplified at 337 and energizes the relay 352 which closes the contacts 352*a* to connect the wiper arm of the potentiometer 354 with the signal comparing junction 357 by way of the time delay circuit 356. The signal which the junction 357 receives from the potentiometer 354 is indicative of the desired lower speed of the input shaft 372. The time delay circuit 356 insures that the intensity of such signal rises gradually to bring about a desirable gradual acceleration of the shaft 372. The signal from the junction 357 is amplified at 373 and is transmitted to the clutch 371 which starts to transmit torque from the constantly driven motor 364 to the shaft 372 at a slowly increasing rate as determined by the circuit 356 to a maximum torque determined by the setting of wiper arm of the potentiometer 354. The motor 364 is driven at a constant speed. The tachometer generator 361 transmits signals which are indicative of the momentary speed of the input shaft 372, and such signals insure that the gradual acceleration of shaft 372 continues until the latter rotates at the desired lower speed.

When the machines 1 and 2 are accelerated to and operate at such lower speed, the person in charge should arrangement the pushbutton 62 which transmits a signal to the erasing input *b* of the signal storing device 339 by way of the OR-gates 378 and 342, and a signal to the input *a* of the signal storing device 341 by way of the OR-gate 378. The relay 352 is deenergized to disconnect the potentiometer 354 from the junction 357, and the output *c* of the signal storing device 341 emits a signal which is amplified at 338 and energizes the relay 353 which closes its contacts 353*a* to connect the junction 357 with the wiper arm of the potentiometer 355 by way of the time delay circuit 356. The circuit 356 again prevents abrupt intensification of the signal which is transmitted to the clutch 371 by way of the amplifier 373 so that teh clutch 371 begins to transmit to the input shaft 372 a torque which gradually increases to the value selected by the setting of potentiometer 355. The junction 357 further receives a second signal which is produced by the tachometer generator 361 and indicates the momentary RPM of the shaft 372.

The machines 1 and 2 can be arrested in response to actuation of the pushbutton 63 which is connected with the erasing inputs *b* of the signal storing devices 339, 341 by way of the OR-gates 342, 343. If the pushbutton 63 is depressed prior to depression of the pushbutton 62 but after depression of the pushbutton 61, the relay 352 is deenergized and the potentiometer 354 is disconnected from the junction 357. If the pushbutton 63 is actuated after depression of the pushbutton 62, the signal storing device 341 deenergizes the relay 353 which disconnects the potentiometer 355 from the junction 357. The time delay circuit 356 is also effective when the person in charge actuates the pushbutton 63, i.e., the circuit 356 insures gradual and smooth deceleration of the shaft 372 in response to depression of the pushbutton 63 subsequent to depression of the pushbutton 61 or 62 as well as when the pushbutton 61 is actuated subsequent to actuation of the pushbutton 62 (note that the OR-gate 377 is connected with the erasing input *b* of the signal storing device 341 by way of the OR-gate 343). Thus, the circuit 356 insures gradual and smooth acceleration or deceleration of the shaft 372 regardless of whether the acceleration is from zero speed to a lower speed or from a lower speed to a higher speed and regardless of whether the deceleration is from a higher speed to zero, from a lower speed to zero or from a higher speed to a lower speed.

If the supply of filter cigarettes 101 in the magazine 4 of the filter cigarette machine 2 rises to the level of the upper photoelectric detector 106 (for example, because the packing machine 12 is arrested or is operated at less than normal speed), the light sensitive element of the detector 106 transmits a signal to the pulse shaper 374 which transmits a rectangular signal to the corresponding input of the OR-gate 377 which in turn transmits a signal to the input *a* of the signal storing device 339. The signal from the OR-gate 377 is further transmitted to the erasing input *b* of the signal storing device 341. Thus, if the shaft 372 is driven at the higher speed, the signal from the detector 106 deenergizes the relay 353 and energizes the relay 352 to cause a gradual reduction of RPM of the shaft 372 to that RPM which is determined by the setting of potentiometer 354. The time delay circuit 356 insures that the RPM of the shaft 372 decreases gradually.

If the supply of filter cigarettes 101 in the magazine 4 decreases so that the light sensitive element of the detector 107 can transmit a signal to the pulse shaper 376, the latter emits a rectangular signal which reached the input *a* of the signal storing device 341 by way of the OR-gate 378 and the erasing input *b* of the signal storing device 339 by way of the OR-gates 378 and 342. The detector 107 can produce a signal when the output of the filter cigarette making machine 2 does not match the requirments of the packing machine because the machine 12 is operated at full speed while the machine 2 is operated at a lower speed, or when the testing means of the filter cigarette making machine 2 segregates a substantial number of defective filter cigarettes while the machine 2 is operated at the lower speed and the machine 12 is also operated at a lower speed which is normally required to insure that the machine 12 consumes the entire output of the machine 2.

The signal storing device 339 then deenergizes the relay 352 and the signal storing device 341 energizes the relay 353 which connects the junction 357 with the potentiometer 355 so that the shaft 372 is accelerated at a rate determined by the time delay circuit 356. The supply of filter cigarettes 101 in the magazine 4 begins to increase and the speed of the shaft 372 is again reduced when the articles 101 in the magazine 4 interrupt the light beam between the light source and the light sensitive element of the detector 106.

It will be seen that the control circuit of FIG. 11 can effect gradual changes in the RPM of the shaft 372 (the speed of the machines 1 and 2) at the will of the person in charge (in response to actuation of the pushbuttons 61, 62, 63) and also in dependency on the positioning of detectors 106, 107 which scan the supply of articles 101 issuing from the machine 2 and being held in readiness for introduction into the packing machine 12.

The control circuit of FIG. 11 is susceptible of many additional modifications. Thus, the speed of the machines 1 and 2 can be changed in response to changes in operation of the packing machine. For example, if the machines 1 and 2 are driven at a normal speed and the packing machine 12 is arrested, such stoppage of the machine 12 can result in the generation of a signal which deenergizes the relay 353 and energizes the relay 352 to reduce the speed of the machines 1 and 2 and to thus reduce the rate at which the supply of articles 101 in the magazine 4 increases while the machine 12 is idle. Also, the shaft 372 can be decelerated in response to malfunctioning of the packing machine 12. As indicated in FIG. 11 by phantom lines, the relay 129 (see also FIG. 7) which starts or stops the motor 130 of the packing machine 12 can be provided with a first set of contacts 129*a* which open or complete the circuit of the motor 130, and with an auxiliary contact 129*b* which closes when the contacts 129*a* are open (i.e., when the machine 12 is idle) to transmit a signal to the OR-gate 377 and to the input *a* of the signal storing device 339 which energizes the relay 352 to connect the potentiometer 354 with the junction 357, and to simultaneously transmit a signal to the erasing input *b* of the signal storing device 341 (by way of OR-gates 377 and 343) which deenergizes the relay 353 with the result that the speed of the shaft 372 decreases gradually in response to stoppage of the machine 12. The auxiliary contact 129*b* insures that the machines 1 and 2 need not be arrested in response to a short-lasting stoppage of the packing machine 12. When the machine 12 is started again and its requirements exceed the output of the machine 2, the supply of cigarettes 101 in the magazine 4 decreases the detector 107 thereupon automatically deenergizes the relay 352 and energizes the relay 353 to increase the RPM of the shaft 372 in a manner as described above.

The clutch 371 is preferably an inductively operated clutch or a magnet powder clutch.

Figure 12:
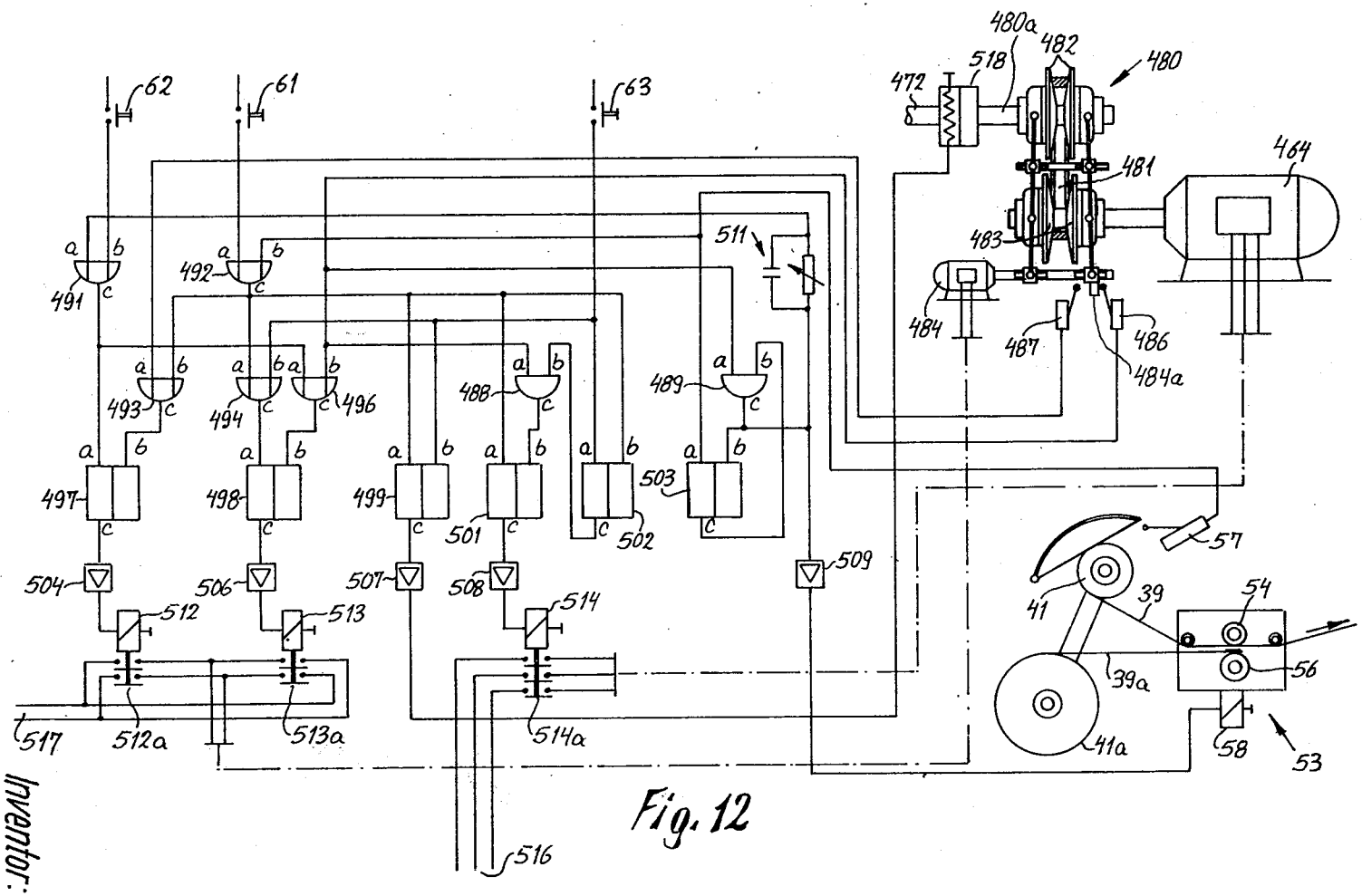
FIG. 12 is a diagram of a fifth control circuit for the production line of FIG. 1.
Figure 13:
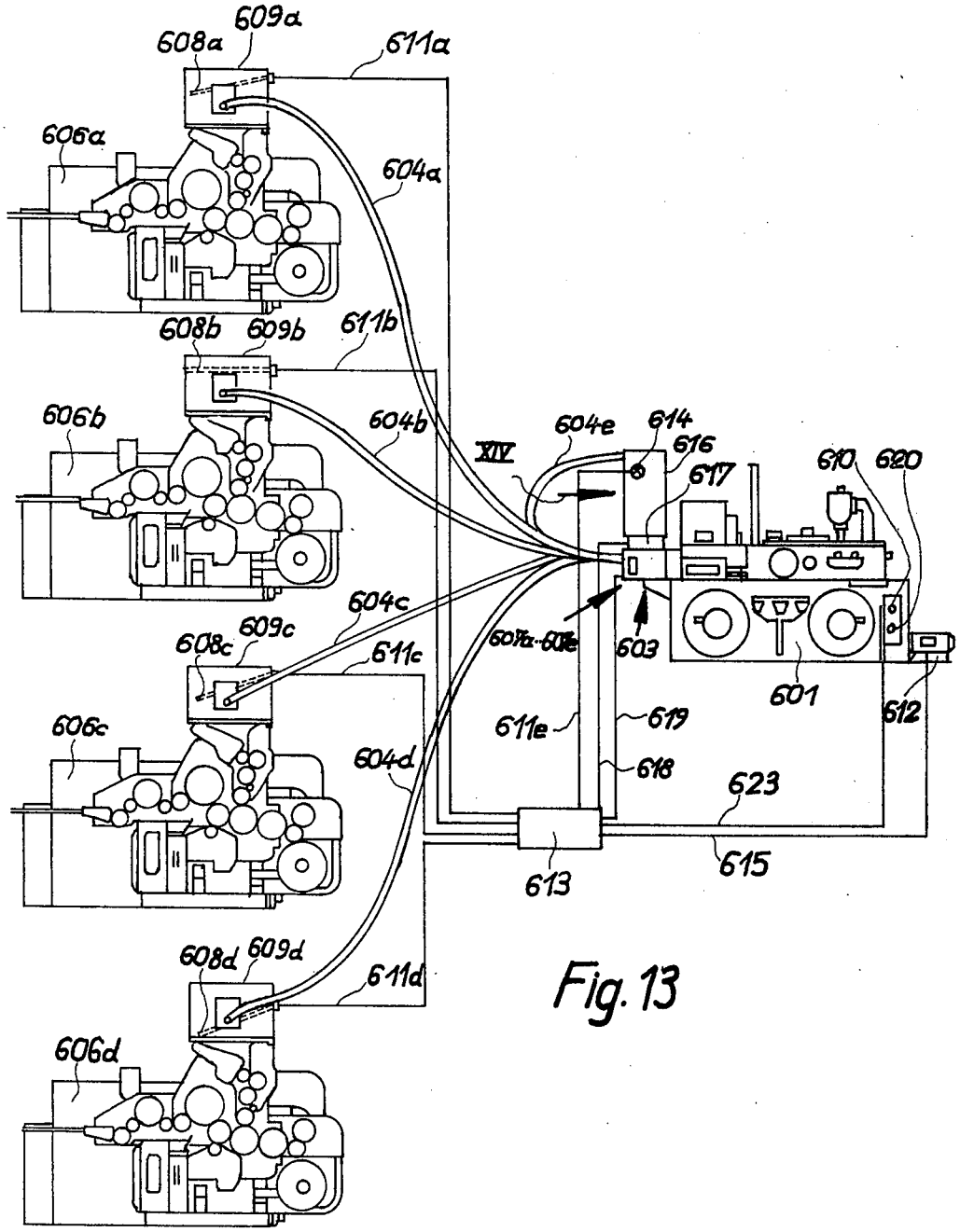
FIG. 13 is a diagrammatic elevational view of a second production line which includes a single producing machine constituting a filter rod making machine and four consuming machines each of which constitutes a filter cigarette making machine.

The control circuit of FIG. 12 also serves to regulate the operation of the machines 1 and 2. The input shaft 472 of the machines 1 and 2 is driven by a prime mover which includes an electric motor 464, an infinitely variable-speed transmission 480 replacing the clutch 371 of FIG. 11, and a clutch 518. The motor 464 is a polyphase synchronous motor.

The transmission 480 comprises an endless V-belt 481 which is trained over pulleys 482, 483. The pulleys have flanges which are movable axially toward and away from each other to thereby gradually change the ratio of the transmission 480. The means for moving the flanges of the pulleys 482, 483 comprises a reversible electric servomotor 484. Two limit switches 486, 487 are mounted adjacent to the path of a trip 484*a* on the linkage which is actuated by the servomotor 484 to respectively determine the minimum and maximum speeds of the output element 480*a* of the transmission 480. The element 480*a* drives one element of the clutch 518.

The control circuit of FIG. 12 is designed to regulate the speed of the machines 1 and 2 at the will of the person in charge (i.e., in response to actuation of the pushbuttons 61, 62 and 63) as well as in response to changes in the condition of a mechanism or unit of the cigarette rod making machine 1. In the illustrated embodiment, the selected unit of the machine 1 is the splicing mechanism 53 which is shown again in the lower right-hand portion of FIG. 12. The control circuit further comprises AND-gates 488, 489, OR-gates 491, 492, 493, 494, 496, signal storing devices 497, 498, 499, 501, 502, 503, amplifiers, 504, 506, 507, 508, 509, an R-C link 511, and motor relays 512, 513, 514 having contacts 512*a*, 513*a*, 514*a*. The contacts 512*a*, 513*a* can connect the servomotor 484 with a source of direct current by way of the leads 517, and the contacts 514*a* can connect the motor 464 with a source of polyphase current by way of the leads 516. The AND-gates 488, 489 have outputs *c* which transmit signals in response to reception of signals at both inputs *a*, *b* of the respective gate. The clutch 518 is an electrically operated clutch which is installed between the input shaft 472 of the cigarette rod making machine 1 and the output element 480*a* of the transmission 480.

The control circuit of FIG. 12 can regulate the speed of the input shaft 472 in response to actuation of pushbuttons 61, 62, 63 as well as in response to changes in the condition of the machine 1, namely, in response to a depletion of the supply of running or expiring web 39. The arrangements is such that the RPM of the shaft 472 is gradually reduced for splicing of the expiring web 39 to the leading end of the fresh web 39*a*.

The operation of the control circuit of FIG. 12:

If the machines 1 and 2 are to be started, the person in charge actuates the pushbutton 61 to transmit a signal to the input *a* of the OR-gate 492. The output *c* of the OR-gate 492 would normally transmit a signal to the input *a* of the signal storing device 498 by way of the OR-gate 494. The amplifier 506 would energize the relay 513 which would close the contacts 513*a* to connect the servomotor 484 with the source of d-c current by way of the leads 517. However, the trip 484*a* is assumed to engage the limit switch 486 which transmits a signal to the erasing input *b* of the signal storing device 498 by way of the OR-gate 496 so that the device 498 is unable to energize the relay 513.

The signal which is produced in response to actuation of the pushbutton 61 is further transmitted to the input *a* of the signal storing device 501 (by way of the OR-gate 492) which causes the amplifier 508 to energize the relay 514 whereby the relay 514 closes its contacts 514*a* and connects the motor 464 with the energy source by way of the leads 516. The motor 464 begins to rotate at a predetermined constant speed.

The signal from the pushbuttom 61 is also transmitted to the input *a* of the signal storing device 499 (by way of the OR-gate 492) which causes the amplifier 507 to engage the clutch 518. Thus, the motor 464 can drive the input shaft 472 by way of the transmission 480 and clutch 518. The shaft 472 is gradually accelerated to a lower speed which is determined by the ratio of the variable-speed transmission 480 (such ratio is assumed to be a ratio at which the input shaft 472 is accelerated to the lower of two speeds because the trip 484*a* engages the limit switch 486).

The person in charge will normally actuate the pushbutton 62 when the machine 1 is fully accelerated to and runs at the lower speed corresponding to the lowest speed ratio of the transmission 480. The pushbutton 62 transmits a signal to the input *a* of the signal storing device 497 by way of the OR-gate 491. The output *c* of the signal storing device 497 transmits a signal to the amplifier 504 which energizes the relay 512 to close the contacts 512*a* and to thus connect the servomotor 484 with the energy source by way of the leads 517. The polarity of current is such that the output shaft of the motor 484 is rotated in a direction to gradually move the flanges of the lower pulley 483 toward each other and to gradually move the flanges of the upper pulley 482 apart whereby the ratio of the transmission 480 increases gradually and smoothly and the input shaft 472 is accelerated to the higher or normal speed. The acceleration of the shaft 472 is terminated when the trip 484*a* reaches and actuates the limit switch 487. The switch 487 then transmits a signal to the erasing input *b* of the signal storing device 497 by way of the OR-gate 493 so that the relay 512 is deenergized and opens its contacts 512*a* to disconnect the servomotor 484 from the energy source. Thus, the output shaft of the servomotor 484 is at a standstill and the transmission 480 remains in that condition in which its ratio is such that the input shaft 472 is driven at the maximum speed.

In order to arrest the machine 1 (and hence the machine 2), the person in charge actuates the pushbutton 63 which transmits a signal to the erasing input *b* of the signal storing device 499. The latter disengages the clutch 518 to terminate the transmission of torque from the output element 480*a* of the transmission 480 to the input shaft 472. The pushbutton 63 also transmits a signal to the input *a* of the signal storing device 498 (by way of the OR-gate 494) whereby the amplifier 506 energizes the relay 513 which closes the contacts 513*a* to reverse the polarity of the servomotor 484 which drives its output shaft in a direction to gradually return the trip 484*a* to the position of FIG. 12 so that the trip 484*a* actuates the limit switch 486. Thus, the ratio of the transmission 480 is changed to the lowest transmission ratio. The limit switch 486 transmits a signal to the erasing input *b* of the signal storing device 498 by way of the OR-gate 496 so that the relay 513 becomes deenergized and opens its contacts 513*a* to disconnect the servomotor 484 from the energy source as soon as the trip 484*a* returns to the illustrated position.

The pushbutton 63 further transmits a signal to the input *a* of the signal storing device 502 whereby the device 502 transmits signal to the erasing input *b* of the signal storing device 501 (by way of the AND-gate 488). The device 501 opens the contacts 514*a* by deenergizing the relay 514. The motor 464 is thus disconnected from the source of polyphase current. The AND-gate 488 is capable of emitting signal because its input *a* receives a signal from the limit switch 486 which is engaged by the trip 484*a*.

The splicing mechanism 53 carries out a splicing operation (to roll a pressure splice between the webs 39 and 39*a*) in the following way:

It is assumed that the machine 1 is driven at the higher or normal speed, i.e., that the trip 484*a* engages the limit switch 487 so that the transmission 480 drives its output element 480*a* at a maximum RPM. When the detector 57 detects that the supply of running web 39 on the expiring bobbin 41 is reduced to a predetermined mininum value, it produces a signal which is transmitted to the input *a* of the signal storing device 503 and to the input *b* of the OR-gate 492. As a rule, the detector 57 is mounted in such a way that it can scan the diameter of the bobbin 41; however, it is clear that the detector 57 can be replaced with a signal generating device which transmits to the signal storing device 503 and to the OR-gate 492 a signal when the weight of the bobbin 41 is reduced to a value which is indicative of imminent expiration of the running web 39. The signal storing device 503 transmits a signal to the input *b* of the AND-gate 489. The OR-gate 492 transmits a signal to the input *a* of the signal storing device 498 by way of the OR-gate 494 whereby the device 498 energizes the relay 513 to close the contacts 513*a*. The servomotor 484 then drives its output shaft in a direction to move the trip 484*a* away from the limit switch 487 and toward engagement with the limit switch 486, i.e., to gradually reduce the ratio of the transmission 480 so that the RPM of the shaft 472 is reduced at a rate depending on the speed at which the trip 484*a* moves from the limit switch 487 toward the limit switch 486. The latter then transmits a signal to the erasing input *b* of the signal storing device 498 to deenergize the relay 513 and to disconnect the servomotor 484 from the source of d-c current at a time when the trip 484*a* dwells in the illustrated position. The limit switch 486 further transmits a signal to the input *a* of the AND-gate 489 which transmits a signal to the erasing input *b* of the signal storing device 503. At the same time, the output *c* of the AND-gate 489 transmits a signal to the electromagnet 58 (by way of the amplifier 509) to raise the roller 56 and to thus press the leader of the fresh web 39*a* against the expiring web 39. The R-C link 511 transmits from the output *c* of the AND-gate 489 a signal to the input *a* of the signal storing device 497 (by way of the OR-gate 491) with a delay which suffices to allow for completion of the splicing operation. The signal storing device 497 energizes the relay 512 which connects the servomotor 484 to the source of d-c current. The servomotor 484 adjusts the ratio of the transmission 480 at a desired rate of speed so that the RPM of the input shaft 472 increases gradually to the RPM which is desirable for normal operation of the machines 1 and 2. Once the adjustment of the transmission 480 is completed, the trip 484*a* engages the limit switch 487 which transmits a signal to the erasing input *b* of the signal storing device 497 by way of the OR-gate 493 whereby the signal storing device 497 deenergizes the relay 512 to open the switches 512*a* and to leave the transmission 480 in a state of adjustment which corresponds to the maximum RPM of the input shaft 472. The gradually accelerated parts of the machine 1 effect gradual acceleration of the fresh web 39*a* to the normal speed to thus prevent tearing of the web 39*a* during or immediately after the completion of splicing operation. Such gradual acceleration preferably takes place during an interval of at least three seconds. Acceleration or deceleration intervals of at least 3 seconds are sufficient to insure that the weight of cigarettes which are produced during acceleration or deceleration does not deviate from a desired optimum weight and also that the web of cigarette paper or tape which is to form adhesive-coated uniting bands does not tear during acceleration from zero speed to a lower speed or from a lower speed to a higher speed.

A feature common to the control circuits of FIGS. 9, 10, 11 and 12 is that the machines 1, 2 can be gradually started, arrested and their operating speed gradually changed at the will of the person in charge as well as in dependency on changes in the condition of certain units in the machine 1, 2 or 12. Such gradual changes in speed can be brought about irrespective of whether the input shaft of the machine 1 is rotated by a prime mover which includes a variable-speed motor, a constant-speed motor in combination with a variable-torque clutch or a constant-speed motor in combination with a conventional clutch and a variable-speed transmission. As mentioned above, the illustrated and described units and mechanisms (such as the unit shown in FIGS. 5–6, the unit of FIG. 7 or the splicing mechanism 53) are but a few examples of units and mechanisms which can influence the speed or cause stoppage of the machines 1, 2 and 12. Furthermore, the prime mover (464, 480, 518) of FIG. 12 can be used in combination with the control circuit of FIG. 9 or 11, the prime mover (364, 371) of FIG. 11 can be used in combination with the control circuit of FIG. 9 or 12, and the prime mover (64' or 64'') of FIG. 9 or 10 can be used in combination with the control circuit of FIG. 11 or 12. Still further, the control circuits of the present invention can be used for regulating the operation of other types of producing machines, such as the machines for production of a continuous wrapped tobacco rod which is to be subdivided to yield cigars, cigarillos or the like, or the machines for production of a continuous wrapped filter rod which is to be subdivided to yield filter plugs for use in apparatus for the production of filter cigarettes or filter-tipped cigars.

FIGS. 13 to 17 illustrate a group of machines or production line which comprises a producing machine 601 and several (e.g., four) consuming machines 606*a*, 606*b*, 606*c*, 606*d*. The machine 601 produces a continuous wrapped filter rod which is subdivided into filter rod sections F of desired length which are fed to the consuming machines 606*a*–606*d* by way of a pneumatic conveyor system including pipes or conduits 604*a*, 604*b*, 604*c*, 604*d*. Each of the consuming machines 606*a*–606*d* is assumed to be identical with the filter cigarette making machine 2 of FIG. 4. The machine 601 is somewhat similar to the cigarette rod making machine 1. The numeral 603 denotes a distributor system which serves to admit filter rod sections F into the conduit 604*a*, 604*b*, 604*c* or 604*d*, depending on the requirements of the respective consuming machine.

The distributor system 603 comprises a driven drum-shaped conveyor 621 (see FIGS. 14–17) which receives filter rod sections F from the producing machine 601 and can deliver such sections to one of four transfer units 607*a*, 607*b*, 607*c*, 607*d* serving to introduce the thus received sections F into the respective conduits 604*a*–604*d* for pneumatic transport to the respective consuming machines 606a–606d. When a consuming machine is in need of fresh filter rod section F, the respective transfer unit delivers to the corresponding conduit 604a, 604b, 604c or 604d a continuous stream or row of sections. The transfer units 607a–607d can be said to form part of the distributor system 603 and are respectively connected with signal generating devices or detectors 608a, 608b, 608c, 608d of the consuming machines 606a–606d. The detectors 608a–608d scan the supply of filter rod sections F in the magazines 609a, 609b, 609c, 609d of the respective consuming machines and transmit signals to the respective transfer units 607a–607d when the supply of filter rod sections in the respective magazine has shrunk to a predetermined lower level or when the supply or filter rod sections is less than in the other magazines. The signals from the detectors 608a–608d to the transfer units 607a–607d are respectively transmitted by way of conductors 611a, 611b, 611c, 611d. These conductors form part of a control circuit 613 the details of which are illustrated in FIG. 18. The magazines 609a–609d correspond to the magazine 73 of FIG. 4.

The distributor system 603 is mounted at a level below an auxiliary magazine 616 for temporary storage of a floating supply of those filter rod sections F which are turned out by the producing machine 601 while the magazines 609a–609d are not ready for reception of sections. The auxiliary magazine 616 can receive sections F by way of an auxiliary pneumatic conduit or pipe 604e. The magazine 616 is associated with a withdrawing unit 617 which serves to transport sections F from the magazine 616 back to the distributor system 603 at certain stages of the operation, for example, when the machine 606a–606d are running while the machine 601 is idle or when the machines 606a–606d are operated at full speed while the machine 601 turns out filter rod sections F at less than a maximum rate. The withdrawing unit 617 is responsive to signals which are transmitted thereto from the control circuit 613 by way of conductors 618 (only one shown in FIG. 13). Such signals serve to initiate the transport of sections F from the auxiliary magazine 616 to the distributor system 603. A further or auxiliary transfer unit 607e is provided to transfer filter rod sections F from the conveyor 621 of the distributor system 603 into the conduit 604e for penumatic transport into the magazine 616. Conductors 619 (only one shown in FIG. 13) are provided to transmit from the control circuit 613 to the transfer units 607a–607e signals which initiate the transfer of sections F from the conveyor 621 to the respective conduits 604a–604e.

A photoelectric detector 614 is installed in or on the auxiliary magazine 616 to produce a signal when the magazine 616 accumulates a predetermined maximum quantity of sections F. Such signal is transmitted to the control circuit 613 by way of conductor means 611e.

The prime mover of the producing machine 601 comprises a d-c motor 612 which is connected with the control circuit 613 by conductor means 615. Pushbuttons 610, 620 on a control panel of the machine 601 are connected with the control circuit 613 by conductor means 623. The pushbutton 610 is actuated to start the machine 601 and the machine 601 is stopped in response to actuation of the pushbutton 620.

Figure 17:
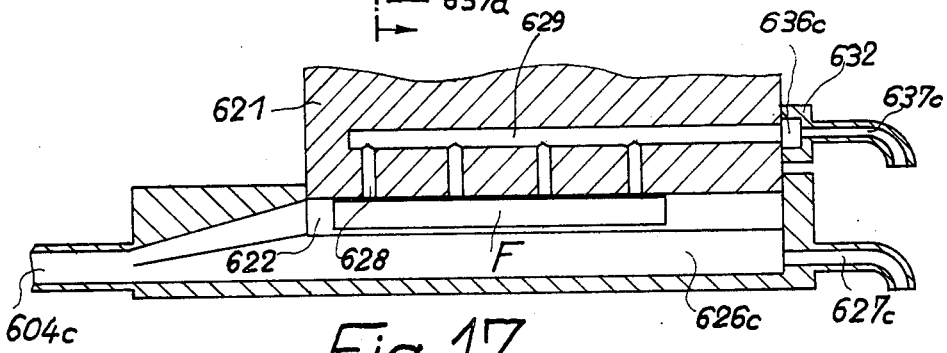
FIG. 17 is a sectional view as seen in the direction of arrows from the line XVII-XVII of FIG. 16.
Figure 18:
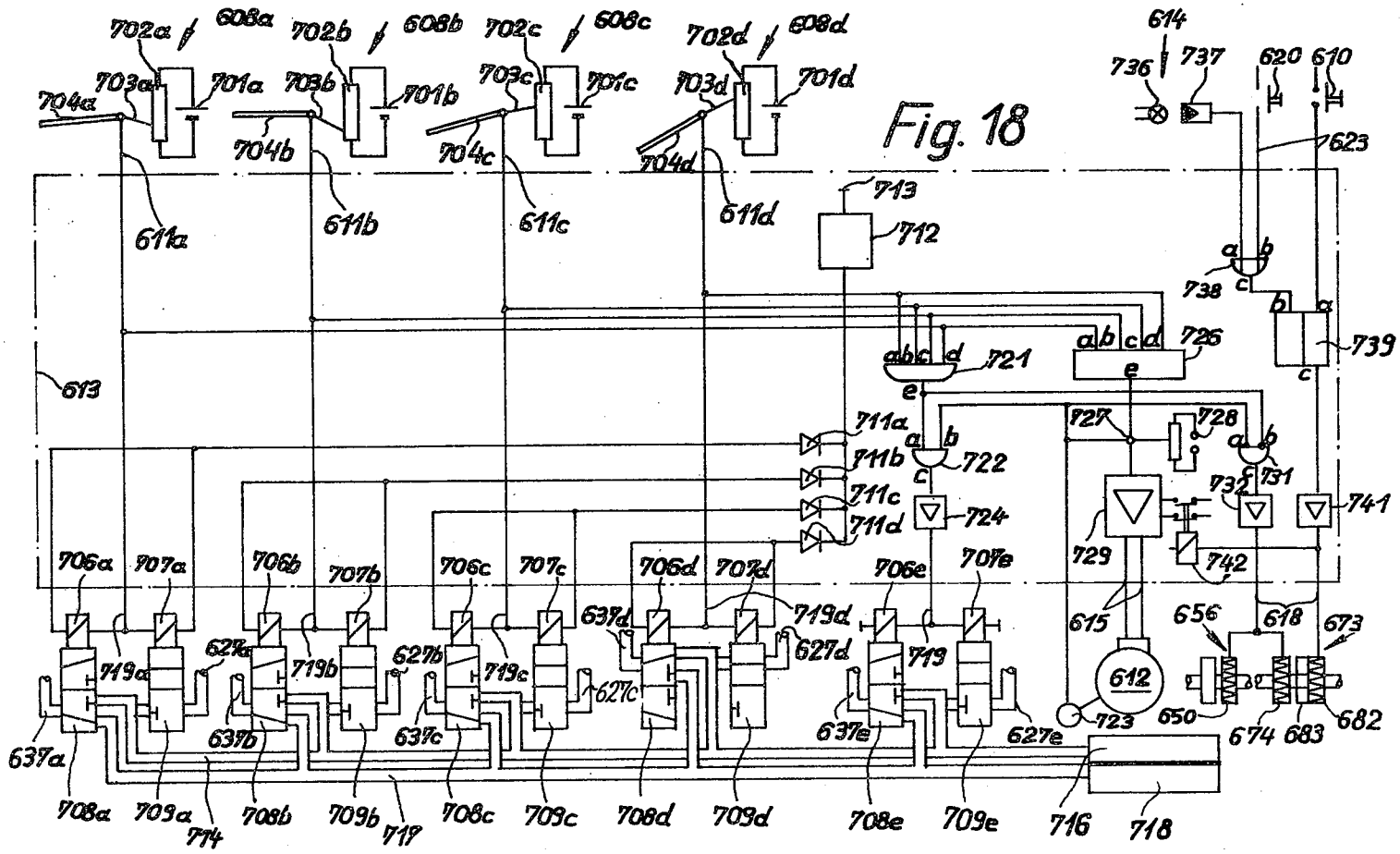
FIG. 18 is a diagram of the control circuit for the production line of FIG. 13.

As shown in FIGS. 14–17, the transfer units 607a–607e comprise chambers 626a, 626b, 626c, 626d, 626e which are adjacent to the path of receiving means or flutes 622 provided in the periphery of the conveyor 621. FIG. 17 illustrates the chamber 626c of the transfer unit 607c in longitudinally section. This chamber 626c narrows gradually in the direction of travel of filter rod sections F toward the corresponding conduit 604c. The rear (right-hand) end of the chamber 626c is connected to the discharge end of a conduit 627c which serves to admit compressed air to thus propel a section F from the chamber 626c into the conduit 604c. The conveyor 621 is provided with radially inwardly extending ports 628 (see particularly FIG. 17) which communicate with the bottom regions of the flutes 622 and with axially parallel channels 629 of the conveyor 621. The channels 629 are blind bores which extend to the right-hand end face of the conveyor 621 and can communicate at certain intervals and for predetermined periods of time with an arcuate groove 631 of a valve plate 632 which is stationary and bears against the right-hand end face of the conveyor. The groove 631 is connected wit a suction tube 633 which in turn is connected with the intake of a suction fan or another suitable suction generating device 718 (FIG. 18). The valve plate 632 is further provided with recesses 636a, 636b, 636c, 636d, 636e which respectively communicate with conduits 637a, 637b, 637c, 637d, 637e for admission of compressed air from a source 716 (FIG. 18) or for connection to the suction generating device 718. The manner in which the flow of air through the conduits 637a–637e is controlled by electromagnetically operated valves will be described in connection with FIG. 18.

Figure 14:
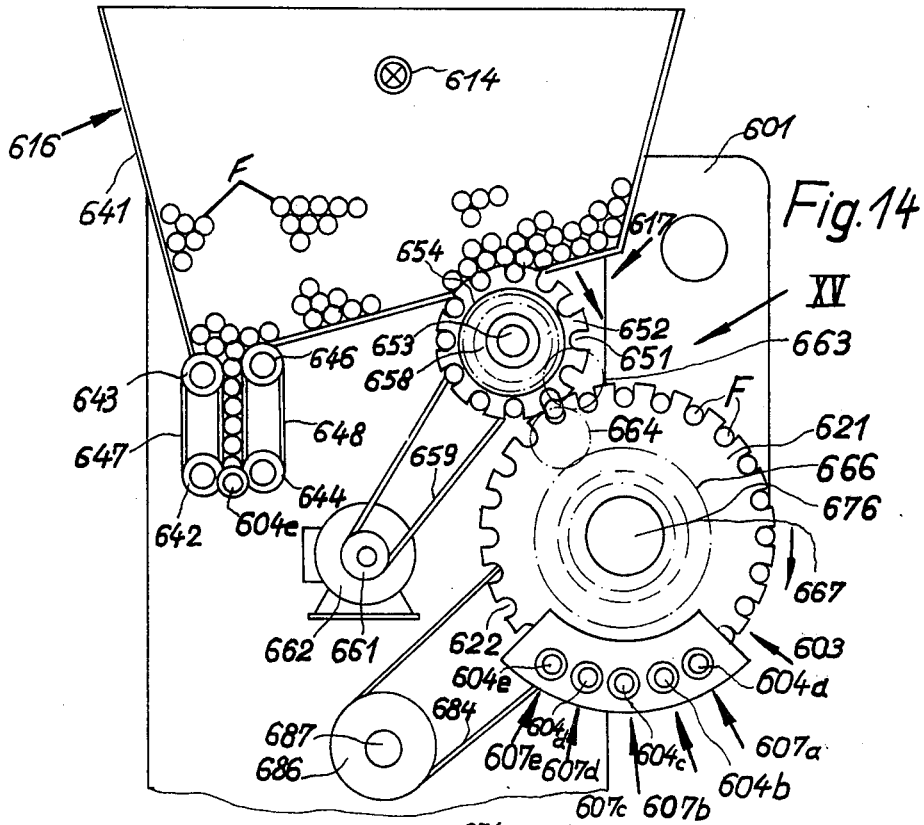
FIG. 14 is an enlarged view of an auxiliary magazine which is associated with the producing machine of FIG. 13, the view being taken in the direction of arrow XIV shown in FIG. 13.
Figure 15:
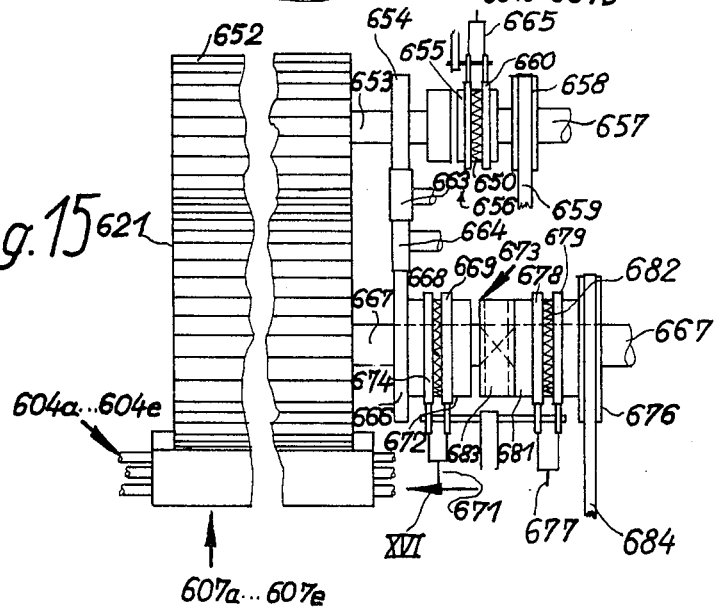
FIG. 15 is an end elevational view of an article withdrawing unit and of a distributor unit substantially as seen in the direction of arrow XV in FIG. 14.
Figure 16:
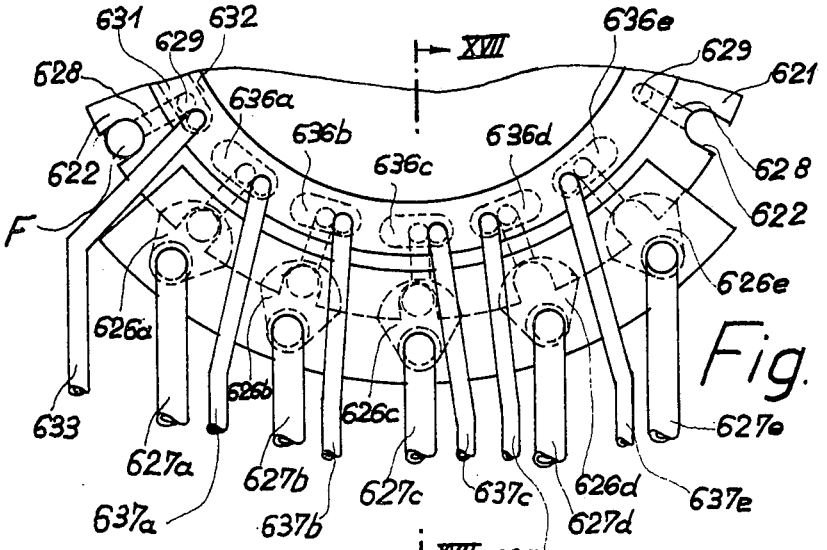
FIG. 16 is an enlarged side elevational view of a detail of the distributor unit as seen in the direction of arrow XVI shown in FIG. 15.

FIG. 14 and 15 illustrate the details of the structure which delivers filter rod sections F into the auxiliary magazine 616 and the details of the withdrawing unit 617. The auxiliary magazine 616 has a hopper or receptacle 641 which stores filter rod sections F delivered from the conveyor 621 by way of the conduit 604e. The sections F which issue from the conduit 604e are propelled into a channel between two continuously driven endless belts 647, 648 which are respectively trained over rollers 642, 643 and 644, 646 and transport the sections upwardly and sideways into the bottom zone of the hopper 641. The detector 614 has a light source and a light sensitive element which is normally illuminated by the beam of light issuing from the source and produces an electric signal when the light beam is interrupted by sections F in the hopper 641, i.e., when the supply of sections F in the auxiliary magazine 616 rises to a predetermined level.

The withdrawing unit 617 comprises a rotary drum-shaped conveyor 652 which is provided with axially parallel receiving means or flutes 651. The shaft 653 of the conveyor 652 is fixed to a spur gear 654 and can receive torque from a drive shaft 657 by way of an electrically operable clutch 656. The shaft 657 is connected with a toothed driver pulley 658 which is rotated by a toothed belt 659 to avoid slippage. The belt 659 is further trained over a second toothed pulley 661 which is mounted on the output shaft of a constantly driven electric motor 662. The clutch 656 has a winding 650 which can be connected with an energy source by way of slip rings 655, 660 and conductors 665.

The gear 654 on the shaft 653 forms part of a gear train which further includes intermediate gears 663, 664 and a gear 666 which is free to rotate on but is held against axial movement relative to the shaft 667 of the conveyor 621. The shaft 667 is coaxial with a two-way clutch 673 and rotatably supports a first holder 672 for a coil 674 of the clutch 673. The holder 672 is held against axial movement on the shaft 667 and its coil 674 can be connected with an energy source by way of slip rings 668, 669 and conductor means 671. The shaft 667 rotatably supports a toothed pully 676 which is driven by a toothed belt 684 trained over a second toothed pulley 686 which is driven by a shaft 687. The pulley 676 is connected with a holder 681 for a second coil 682 of the clutch 673. The coil 682 can be connected with an energy source by way of slip rings 678, 679 and conductor means 677. The pulley 676 and the holder 681 are held against axial movement on the shaft 667. The space between the holders 672, 681 accommodates a torque-transmitting disk 683 which is movable axially of the shaft 667 but is held against rotation relative to this shaft. The end surfaces of the disk 683 are toothed and the holders 672, 681 are provided with toothed surfaces which face the respective toothed surfaces of the disk 683. The teeth on the parts 672, 681, 683 are known as Hirth-tuype serrations. The disk 683 can be driven by the holder 672 or 681 in response to energization of the respective coil 674 or 682 to thereby rotate the shaft 667. The shaft 686 for the pulley 687 is driven by the motor 612 of the machine 601.

FIG. 18 illustrates the details of the control circuit 613, of the detectors 608*a*–608*d*, and of the detector 614. The detectors 608*a*–608*d* respectively comprise energy sources 701*a*, 701*b*, 701*c*, 701*d* and potentiometers 702*a*, 702*b*, 702*c*, 702*d* which are in circuit with the respective energy sources 701*a* –701*d* and respectively comprise wiper arms 703*a*, 703*b*, 703*c*, 703*d* which are connected with scanning arms 704*a*, 704*b*, 704*c*, 704*d*. The scanning arms 704*a*–704*d* respectively rest on top of the supplies of filter rod sections F in the magazines 609*a*–609*d*. In the illustrated embodiment, the scanning arms 704*a*–704*d* are mounted for pivotal movement in response to fluctuations of the upper levels of supplies of sections F in the respective magazines 609*a*–609*d* to thereby change the positions of the associated wiper arms 703*a*–703*d*. When the level of sections in a magazine descends, the respective scanning arm pivots the corresponding wiper arm in a direction toward the positive pole of the energy source, i.e., in a direction of higher potential. When the level of sections F in a magazine rises, the corresponding wiper arm is adjusted in the direction of lower potential. The voltage pulses which are thus produced as a function of the positions of scanning arms 704–704*d* are transmitted to the control circuit 613 by way of conductors 611*a*–611*d* and the currents produced by such voltage pulses flow in a circuit including conductors 719*a*, 719*b*, 719*c*, 719*d*, windings 706*a*, 706*b*, 706*c*, 706*d* and 707*a*, 707*b*, 707*c*, 707*d* of electromagnetically operated valves 708*a*, 708*b*, 708*c*, 708*d* and 709*a*, 709*b*, 709*c*, 709*d*, diodes 711*a*, 711*b*, 711*c*, 711*d*, a source 712 of constant potential and the ground 713. The control circuit 613 is designed in such a way that a current can flow only through that one of the diodes 711*a*–711*d* at which the potential is the highest, i.e., through the diode associated with that scanning arm (704*a*, 704*b*, 704*c* or 704*d*) which is indicative of the lowest level of filter rod sections F in the respective magazine. The valves 708*a*–708*d* can connect the conduits 637*a*–637*d* with a supply conduit 714 for compressed air supplied by the source 716 and with a suction conduit 717 which is connected with the suction generating device 718. The valves 709*a*–709*d* control the flow of air from the conduit 714 to the conduits 627*a*–627*d*.

The signals generated by the detectors 608*a*–608*d* having scanning arms 704*a*–704*d* are further transmitted to the inputs *a*, *b*, *c*, *d* of a logical circuit known as NAND-gate 721 having an output *e* which is connected with the input *a* of an AND-gate 722. The input *b* of the AND-gate 722 is connected with the output of a tachometer generator 723 which serves to produce signals indicating the speed of the d-c motor 612 for the machine 601. The output *c* of the AND-gate 722 is connected with the windings 706*e* and 707*e* of two further electromagnetically operated valves 708*e* and 709*e* by way of conductor means 719 and amplifier 724. The valves 708*e*, 709*e* are respectively installed in the conduits 637*e* and 627*e* which are respectively connected with the conduits 717 and 714. The valve 708*e* can further connect the conduit 637*e* with the conduit 714.

The detectors 608*a*–608*d* are also connected with the inputs *a*, *b*, *c*, *d* of an integrating circuit 726 which can constitute an operational amplifier and has an output *e* which can transmit an integrated signal representing the sum of signals at the inputs *a*–*d*. Such integrated signal is transmitted to a signal comparing junction 727 and is indicative of a desired RPM of the motor 612. The junction 727 further receives signals from a calibrating potentiometer 728. The signal from the calibrating potentiometer 728 is indicative of a desirable minimum RPM of the motor 612 when the signal at the output *e* of the integrating circuit 726 disappears. The output signal from the junction 727 is transmitted to an output amplifier 729 which is connected with the motor 612 by conductor means 615. The just described RPM regulating circuit insures that the acutal RPM of the motor 612 gradually rises to the desired RPM.

The output *e* of the NAND-gate 721 is connected with the input *b* of an AND-NO gate 731; the latter has another input *a* which is connected with the output of the tachometer generator 723. The output *c* of the gate 731 is connected with the coils 650 and 674 of the clutches 656 and 673 by way of an amplifier 732.

The photoelectric detector 614 has a light source 736 and a light sensitive element 737 which latter is connected with the input *a* of an OR-gate 738. The input *b* of the OR-gate 738 is connected with the stop pushbutton 620 on the machine 601. The output *c* of the OR-gate 738 is connected with the erasing input *b* of a signal storing circuit or device 739. The device 739 has a second input *a* which is connected with the starter pushbutton 610 for the machine 601 and an output *c* which is connected with the coil 682 of the clutch 673 by way of an amplifier 741. The output *c* of the signal storing device 739 is further connected with a motor relay 742 (by way of the amplifier 741). The relay 742 has contacts which control the connection between the output amplifier 729 for the motor 612 and the energy source.

The operation of the control circuit 613:

The machine 601 produces a continuous stream of filter rod sections F which are delivered to the distributor system 603 and are to be fed to that one of the magazines 609*a*–609*d* (by way of conduits 604*a*–604*d*) which contains the smallest supply of sections. That scanning arm (704*d* in FIGS. 13 and 18) which assumes a position indicating the smallest supply of sections F causes the corresponding wiper arm (703*d*) to transmit the strongest voltage signal (by way of conductor means 611*d*). Such signal causes a current to flow through the source 712 and through the corresponding diode 711*d* while blocking the flow of current through the other diodes 711*a*–711*c*. The current flowing through the diode 711*d* energizes the windings 706*d*, 707*d* of the valves 708*d*, 709*d* so that the conduits 627*d*, 637*d* connect the transfer unit 607*d* with the supply conduit 714 for compressed air. The conduits 627*a*–627*c* are connected with the suction conduit 717 and the flow of air through the conduits 637*a*–637*c* is blocked.

The starter pushbutton 610 was depressed to start the machine 601 and to transmit a signal to the input *a* of the signal storing device 739. The output *c* of the device 739 transmits a signal which energizes the coil 682 of the clutch 673 by way of amplifier 741. The coil 682 attracts the disk 683 whereby the shaft 687 (FIG. 14) drives the shaft 667 of the conveyor 621. The coil 650 of the clutch 656 is deenergized so that the conveyor 652 of the withdrawing unit 617 is at a standstill. The flutes 622 of the conveyor 621 deliver filter rod sections F to the transfer unit 607*d*. This is due to the fact that the grooves 631 and 636*a*–636*c* of the valve plate 632 (FIG. 16) are connected with the suction generating device 718 so that the ports 628 and channels 629 of the conveyor 621 remain connected with the device 718 during transport of filter rod sections F to the transfer unit 607*d*. When the flutes 622 reach the transfer unit 607*d*, the respective channels 629 and ports 628 of the conveyor 621 are connected with the source 716 of compressed air by way of the conduit 637*d* whereby the sections F enter the chamber 626*d* of the transfer unit 607*d*. Such sections are expelled from the chamber 636*d* by compressed air which is admitted through the conduit 627*d* to move lengthwise through the conduit 604*d* and toward the magazine 609*d* of the machine 606*d*. The transfer of successive sections F from the outlet of the conduit 604*d* into the magazine 609*d* preferably takes place in the same way as shown in FIG. 14 for the introduction of sections F into the hopper 641 of the auxiliary magazine 616. Thus, the section F are moved sideways by a pair of belts corresponding to the belts 647, 648 and enter the lower zone of the magazine 609*d*.

If the supply of sections F in the magazine 609*d* is replenished to such an extent that the scanning arm 704*d* assumes a position of inclination which is less pronounced than the inclination of the scanning arm 704*a*, 704*b* or 704*c*, the transport of sections F to the magazine 609*d* is terminated in a fully automatic way and the distributor system 603 begins to feed sections to another magazine, for example, to the magazine 609*c* of the consuming machine 606*c*. As shown in FIG. 18, the inclination of the scanning arm 704*c* is more pronounced than that of the arms 704*a*, 704*b*. The flow of current through the diode 711*d* is terminated as soon as the voltage signal from the potentiometer 702*d* becomes weaker than the signal from the potentiometer 702*c*. The current then flows from the wiper arm 703*c*, through the diode 711*c*, the source 712 (which keeps tbe current constant) and to the ground 713. There is no flow of current through the diodes 711*a*, 711*b* and 711*d*. The windings 706*d*, 707*d* of the electromagnetically operated valves 708*d*, 709*d* become deenergized and the windings 706*c*, 707*c* of the valves 708*c*, 709*c* are energized. Thus, the filter rod sections F in the flutes 622 of the conveyor 621 are transported to the transfer unit 607*c*. The conduits 627*c*, 637*c* are connected to the source 716 of compressed air so that the sections F are expelled from the flutes 622 into the chamber 626*c* and thence into the conduit 604*c* for transport into the magazine 609*c* of the consuming machine 606*c*. The transfer of sections F from the discharge end of the conduit 604*c* into the magazine 609*c* preferably takes place in a manner as shown in FIG. 14 (see the belts 647, 648).

The same operation is repeated when the supply of sections F ian the magazine 609*c* exceeds the supply of sections in the magazine 609*a*, 609*b* or 609*d*, i.e., the control circuit 613 insures automatic replenishment of the supply of filter rod sections F in the magazine of that consuming machine whose requirements are more urgent than the requirements of the other three consuming machines.

The output signal from the gate 721 is indicative of the desirable optimum RPM of the producing machine 601, i.e., of such RPM which is desirable to insure that the output of the machine 601 matches the combined requirements of the consuming machines 606*a*–606*d*. Thus, if the signal from one of the potentiometers 702*a*–702*d* is very intensive to indicate a very low supply of sections F in the respective magazine, the operating speed of the machine 601 is increased to rapidly replenish the supply of sections F in the magazine of that consuming machine wherein the supply of sections is very low. The operating speed of the machine 601 is relatively low if the signal from one of the potentiometers 702*a*–702*d* is relatively weak.

If one or more consuming machines are temporarily arrested or operate at less than normal speed (due to temporary malfunctioning of one of or more consuming machines or of one or more machines 1 which supply plain cigarettes to the machines 606*a*–606*d*), the supply of filter rod sections F in each of the magazines 609*a*–609*d* is replenished to a maximum permissible level. In order to avoid unnecessary stoppage of the producing machine 601, the output of this machine is then automatically introduced into the auxiliary magazine 616 in the following way:

The output *e* of the gate 721 transmits a signal to the input *a* of the AND-gate 722 while the input *b* of the gate 722 receives a signal from the tachometer generator 723 because the motor 612 is running. The signal from the output *c* of the AND-gate 722 is amplified at 724 and is caused to energize the windings 706*e*, 707*e* of the valves 708*e*, 709*e*. The valves 708*e*, 709*e* then connect the conduits 627*e* and 637*e* with the supply conduit 714 for compressed air whereby the filter rod sections F are expelled from the flutes 622 of the conveyor 621 to enter the conduit 604*e* and to be introduced into the hopper 641 of the auxiliary magazine 616 through the channel between the constantly driven belts 647, 648 (FIG. 14).

When the supply of sections F in the hopper 641 of the magazine 616 rises to a predetermined maximum level, the sections interrupt the light beam between the light source 736 and the light sensitive element 737 of the photoelectric detector 614. The light sensitive element 737 transmits a signal to the input *a* of the OR-gate 738 which tranmsits a signal to the erasing input *b* of the signal storing device 739. The signal at the output *c* of the device 739 disappears so that the relay 742 becomes deenergized and disconnects the amplifier 729 from the energy source to thus arrest the motor 612.

If at least one of the detectors 608*a*–608*d* produces a signal which indicates that the supply of filter rod sections F in the respective magazine 609*a*, 609*b*, 609*c* or 609*d* has decreased to less than the maximum permissible level, the signal at the output *e* of the gate 721 disappears and the gate 721 ceases to transmit a signal to the input *b* of the gate 731. The input *a* of the gate 731 does not receive a signal from the tachometer generator 723 because the motor 612 is idle. Therefore, the output *c* of the gate 731 transmits a signal to the amplifier 732 which energizes the coils 650 and 674 of the clutches 656 and 673. The constantly running motor 662 (FIG. 14) then drives the shaft 667 by way of the clutch 656, gear train 654, 663, 664, 666, holder 672 and disk 683. The motor 662 also drives the shaft 653 of the conveyor 652 so that the flutes 651 of the conveyor 652 withdraw filter rod sections F from the hopper 641 and deliver such sections into the flutes 622 of the conveyor 621. The flutes 622 then deliver sections F to that transfer unit (607*a*, 607*b*, 607*c* or 607*d*) which is to transport sections F to the magazine 609*a*, 609*b*, 609*c* or 609*d* wherein the supply of sections has been depleted to less than the maximum permissible level. The level of the supply of sections F in the hopper 641 of the auxiliary magazine 616 decreases and the descending sections permit the light beam from the light source 736 of the detector 614 to reach the light sensitive element 737. The motor 612 is then ready to be started in response to actuation of the pushbutton 610 which causes the signal storing device 739 and amplifier 741 to energize the relay 742 so that the latter connects the amplifier 729 for the motor 612 with the energy source. The machine 601 resumes the production of filter rod sections F which are transported to one of the magazines 690*a*-609*d* or into the hopper of the magazine 616 in a manner as described above.

If the machine 601 is arrested, for example, due to short-lasting malfunctioning of one of its units, the consuming machines 606*a*-606*d* can continue to operate for a certain period of time which depends on the operating speed of the machines 606*a*-606*d* and on the capacity of the auxiliary magazine 616. Automatic starting of the withdrawing unit 617 which removes filter rod sections F from the hopper 641 and delivers such sections to the flutes 622 of the conveyor 621 of the distributor unit 603 takes place in the following way:

In the first step, the motor 612 of the producing machine 601 is arrested on detection of a defect by actuating the pushbutton 620 which transmits a signal to the erasing input *b* of the signal storing device 739 through the intermediary of the gate 738. The output *c* of the device 739 ceases to transmit a signal to the amplifier 741 whereby the relay 732 opens the connection between the energy source and the amplifier 729 for the motor 612. The coil 682 of the clutch 673 is deenergized in response to disappearance of signal at the output *c* of the signal storing device 739. The output signal from the tachometer generator 723 disappears as soon as the motor 612 is arrested. It is assumed that at least one of the detectors 608*a*-608*d* produces a signal which is indicative that the magazine of the respective consuming machine 606*a*, 606*b*, 606*c* or 606*b* can accept additional filter rod sections F. Thus, at least one of the inputs *a* to *d* of the gate 721 receives a signal; therefore, no signal appears at the output *e* of the gate 721. The output *e* of the gate 721 transmits a signal when no signals are received at the inputs *a* to *d* and the output *e* of the circuit 726 transmits a signal in response to reception of a signal at least at one of its inputs *a* to *d*. The gate 731 transmits a signal to the amplifier 732 which energizes the coils 650 and 674 of the clutches 656 and 673. The coil 674 attracts the disk 683 so that the constantly running motor 662 (FIG. 14) can drive the shaft 667 of the conveyor 621 while the clutch 656 drives the shaft 653 of the conveyor 652. The shaft 667 is driven by way of the shaft 653, gear train 654, 663, 664, 666, holder 672 and disk 683. The gear train insures that the conveyor 621 rotates in synchronism with the conveyor 652 so that the flutes 651 which receive filter rod sections F from the hopper 641 of the auxiliary magazine 616 can properly transfer such sections into the flutes 622 of the conveyor 621. The flutes 622 deliver sections F to that one of the transfer units 607*a*-607*d* which is to introduce filter rod sections into the conduit 604*a*, 604*b*, 604*c* or 604*d* for that consuming machine wherein the supply of filter rod sections is less than in the other three consuming machines.

In order to start the producing machine 601, the person in charge actuates the pushbutton 610 to energize the coil 682 of the clutch 673 by way of the signal storing device 739 and amplifier 741. Also, the signal from the output *c* of the device 739 causes energization of the relay 742 which connects the amplifier 729 for the motor 612 with the energy source. As the motor 612 begins to rotate, the tachometer generator 723 transmits a signal to the gate 731 which ceases to transmit a signal to the amplifier 732. The coils 650 and 674 of the clutches 656 and 673 are deenergized so that the torque-transmitting connection between the constantly driven motor 662 and the shafts 653, 667 of the conveyors 652, 621 is interrupted. This terminates the withdrawal of filter rod sections F from the hopper 641 of the auxiliary magazine 616 by way of the unit 617. The flutes 622 of the conveyor 621 in the distributor unit 603 receive filter rod sections F directly from the producing machine 601.

An important advantage of the production line shown in FIGS. 13 to 18 and of the production lines of FIGS. 1–12 is that the control circuits invariably prevent undesirable (excessive) acceleration or deceleration of producing and consuming machines not only when the machines are started, arrested, accelerated or decelerated by the persons in charge (pushbuttons 61-63, 610, 620) but also when the starting, stoppage, acceleration or deceleration should take place in automatic response to signals which are produced by detectors serving to monitor the operation of such machines.

Another important advantage of the production line of the present invention (particularly of the production line which employs the control circuitry of FIGS. 9 to 12) is that all such changes in the speed of prime movers producting and/or consuming machines which are necessary or desirable due to a change in the condition of one or more units in such machines can be carried out in a fully automatic way without requiring constant supervision by persons in charge.

A further important advantage of the control circuits shown in FIGS. 8–12 and 18 is that they can be installed in existing production lines without necessitating appreciable alterations in the layout or construction of the machines. The components of the circuits require little room and can be installed in spaces which are available in existing production lines.

The term "infinitely variable" is intended to embrace the operation of variable-speed motors, variable-torque clutches or variable-speed transmissions which can insure smooth transition between two or more speeds in stepwise fashion or gradually. If the transition takes place on stepwise fashion, the differences between successive steps are sufficiently small to avoid the aforedescribed drawbacks of conventional prime movers, i.e., that they cannot affect the quality of products, the output, the number of rejects and/or the quantity of starting materials, such as webs, bands, tobacco shreds, filter material and others.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. In a production line for rod-shaped articles which constitute or form part of smoker's products, a combination comprising a machine for making rod-shaped articles, said machine having devices for draping flexible wrapping material around rod-like filler material for severing the draped filler material to form discrete rod-shaped articles and for conveying said discrete articles along a predetermined path, said devices having parts movable at a first speed and at a substantially higher second speed; prime mover means having variable-speed output means connected with said movable parts of said devices; first speed increasing means for accelerating said output means to said first speed; second speed increasing means for accelerating said output means from said first to said second speed at a slower first rate or at a faster second rate; and means for restricting said second speed increasing means to acceleration of said output means at said slower first rate.

2. A combination as defined in claim 1, further comprising an energy source, said second speed increasing means including means for establishing the flow of energy from said source to said prime mover means along first and second paths whereby the acceleration of said output means to said second speed respectively takes place at said first and second rates when the energy respectively flows along said first and second paths, said restricting means including means for preventing the flow of energy along said second path for a predetermined interval of time following the actuation of said second speed increasing means.

3. A combination as defined in claim 2, wherein said prime mover means comprises a variable-speed electric motor and said source is a source of electrical energy.

4. A combination as defined in claim 3, wherein said second speed increasing means includes transformer means.

5. A combination as defined in claim 4, wherein said transformer means has a low-voltage terminal connected with said motor and a high-voltage terminal, said second speed increasing means further comprising a relay connected between said high-voltage terminal and said energy source and being energizable during said interval so that said motor receives low-voltage energy during said interval, said restricting means comprising means for connecting said source directly with said motor after elapse of said interval.

6. A combination as defined in claim 2, wherein said interval is at least three seconds.

7. A combination as defined in claim 1, further comprising a second machine which receives articles from said first machine, and first and second actuating means for respectively activating said first and second speed increasing means, said actuating means being installed in said second machine.

8. A combination as defined in claim 1, wherein said restricting means comprises a timer.

9. A combination as defined in claim 1, wherein said prime mover means comprises a variable-speed electric motor having a high-RPM winding and a low-RPM winding, and further comprising a source of electrical energy, said first speed increasing means including means for connecting said source with said low-RPM winding and said second speed increasing means comprising means for connecting said source with said high-RPM winding along first and second paths, said restricting means including means for interrupting said second path for a predetermined period of time, whereby said motor is accelerated to said second speed at said first rate, and for thereupon completing said second path and for interrupting said first path whereby said motor continues to rotate said output means thereof at least substantially at said second speed.

* * * * *